US010543611B2

(12) United States Patent
Bozikis et al.

(10) Patent No.: US 10,543,611 B2
(45) Date of Patent: Jan. 28, 2020

(54) HEAD CONVERTER

(71) Applicant: BIC-VIOLEX SA, Anixi, Attiki (GR)

(72) Inventors: Ioannis Bozikis, Athens (GR); Dimitrios Efthimiadis, Athens (GR)

(73) Assignee: BIC-VIOLEX SA, Anixi (GR)

( * ) Notice: Subject to any disclaimer, the term of this patent is extended or adjusted under 35 U.S.C. 154(b) by 102 days.

(21) Appl. No.: 15/487,811

(22) Filed: Apr. 14, 2017

(65) Prior Publication Data

US 2018/0297224 A1 Oct. 18, 2018

(51) Int. Cl.
*B26B 21/52* (2006.01)
*B26B 21/22* (2006.01)
*B26B 21/44* (2006.01)

(52) U.S. Cl.
CPC ..... *B26B 21/521* (2013.01); *B26B 21/222* (2013.01); *B26B 21/443* (2013.01)

(58) Field of Classification Search
CPC ... B26B 21/521; B26B 21/222; B26B 21/225; B26B 21/443
See application file for complete search history.

(56) References Cited

U.S. PATENT DOCUMENTS 4,488,357 A * 12/1984 Jacobson ..... B26B 21/225 30/527
9,707,688 B2 * 7/2017 Giannopoulos ..... B26B 21/222
9,844,887 B2 * 12/2017 Griffin ..... B26B 21/521
9,895,817 B2 * 2/2018 Georgakis ..... B26B 21/222
2012/0124840 A1 * 5/2012 Iaccarino ..... B26B 21/225 30/50
2014/0083265 A1 * 3/2014 Provost ..... B26B 21/225 83/13
2015/0290819 A1 * 10/2015 Giannopoulos ..... B26B 21/222 30/532
2015/0314465 A1 * 11/2015 Giannopoulos ..... B26B 21/222 30/532
2017/0036360 A1 * 2/2017 Griffin ..... B26B 21/225
2017/0106549 A1 * 4/2017 Bozikis ..... B26B 21/4043
2017/0266825 A1 * 9/2017 Bozikis ..... B26B 21/4031

* cited by examiner

*Primary Examiner* — Omar Flores Sanchez
(74) *Attorney, Agent, or Firm* — Polsinelli PC

(57) ABSTRACT

A head converter includes a frame configured to be coupled with a blade unit and an interconnecting member pivotably coupled with the frame and configured to be coupled with a handle. The frame extends along a longitudinal axis and includes one or more supports. At least one of the supports of the frame has a camming surface configured to abut and interact with a biasing member.

20 Claims, 12 Drawing Sheets

100
10
130
154
154
160
Y
X
Z
198
196
194
192
190
191

10
X
X
100
130
12
13
160
12
190
Y
X
Z

HEAD CONVERTER

BACKGROUND

1. Field

The following description relates to head converters and shaving razors with head converters. The head converter includes a frame configured to be removably coupled with a blade unit. The frame is pivotably couple with an interconnecting member which is configured to be coupled with a handle.

2. Description of Related Art

Shaving razors include blade units which may contain components such as shaving blades, lubrication strips, guard bars, covers, and trimming blades. The blade units are configured to be coupled with a handle. The blade units, when connected to a handle, may pivot along a pivot axis. To customize the blade unit, for example to provide a different pivot axis to achieve a closer shave in certain areas or to provide a lubrication strip in front of the guard bar of the blade unit, an entirely new blade unit is purchased. Also, when the blades in the blade unit have become dull, the entire shaving razor may need to be replaced.

SUMMARY

The present concept provides a head converter for use with a shaving razor that overcomes the aforementioned disadvantages of conventional shaving razors.

The aforementioned may be achieved in an aspect of the present concept by providing a head converter. The head converter may include a head converter including a frame configured to be coupled with a blade unit and an interconnecting member pivotably coupled with the frame and configured to be coupled with a handle. The frame may extend along a longitudinal axis and may include one or more supports. At least one of the one or more supports may have a camming surface configured to abut and interact with a biasing member. The blade unit may have a first pivot axis. When the blade unit and the frame are coupled, the frame with the blade unit may pivot along a second pivot axis. The first pivot axis and the second pivot axis may be different. The frame and the supports may be configured to provide support to a bottom side of the blade unit. The head converter may further include a seat extending from the frame such that the blade unit is connected to the frame by sitting in the frame and the seat. A top surface of the seat may be configured to function as a lubricant, glide assistance, or a guard bar. AT least one of the one or more supports may have a coupling structure, the coupling structure may be configured to interact with corresponding hooks on the blade unit such that the blade unit is coupled with the frame. The frame may be configured to be removably coupled with the blade unit. The frame may include at least one protrusion configured to be received by corresponding recesses in the blade unit such that the blade unit is coupled with the frame. The interconnecting member may include a recessed portion configured to receive a connecting portion of the handle. The interconnecting member may include an aperture through which the biasing member of the handle extends to interact with the camming surface of the frame. The frame may include two depressions. The interconnecting member may include two attachment components which correspond with the two depressions in the frame such that the interconnecting member is pivotably coupled with the frame. The two attachment components may be shell bearings.

The aforementioned may be achieved in another aspect of the present concept by providing a shaving razor. The shaving razor may include a handle, a heard converter removably coupled with the handle, and a blade unit coupled with the head converter. The head converter may include a frame extending along a longitudinal axis. The frame may include one or more supports. At least one of the one or more supports may have a camming surface configured to abut and interact with a biasing member.

The foregoing is intended to be illustrative and is not meant in a limiting sense. Many features of the examples may be employed with or without reference to other features of any of the examples. Additional aspects, advantages, and/or utilities of the present concept will be set forth in part in the description that follows and, in part, will be apparent from the description, or may be learned by practice of the present concept.

BRIEF DESCRIPTION OF THE DRAWINGS

The foregoing summary, as well as the following detailed description, will be better understood when read in conjunction with the appended drawings. For the purpose of illustration, there are shown in the drawings certain examples of the present disclosure. It should be understood, however, that the present concept is not limited to the precise examples and features shown. The accompanying drawings, which are incorporated in and constitute a part of this specification, illustrate an implementation of apparatuses consistent with the present concept and, together with the description, serve to explain advantages and principles consistent with the present concept.

DETAILED DESCRIPTION

Figures 1A, 1B:
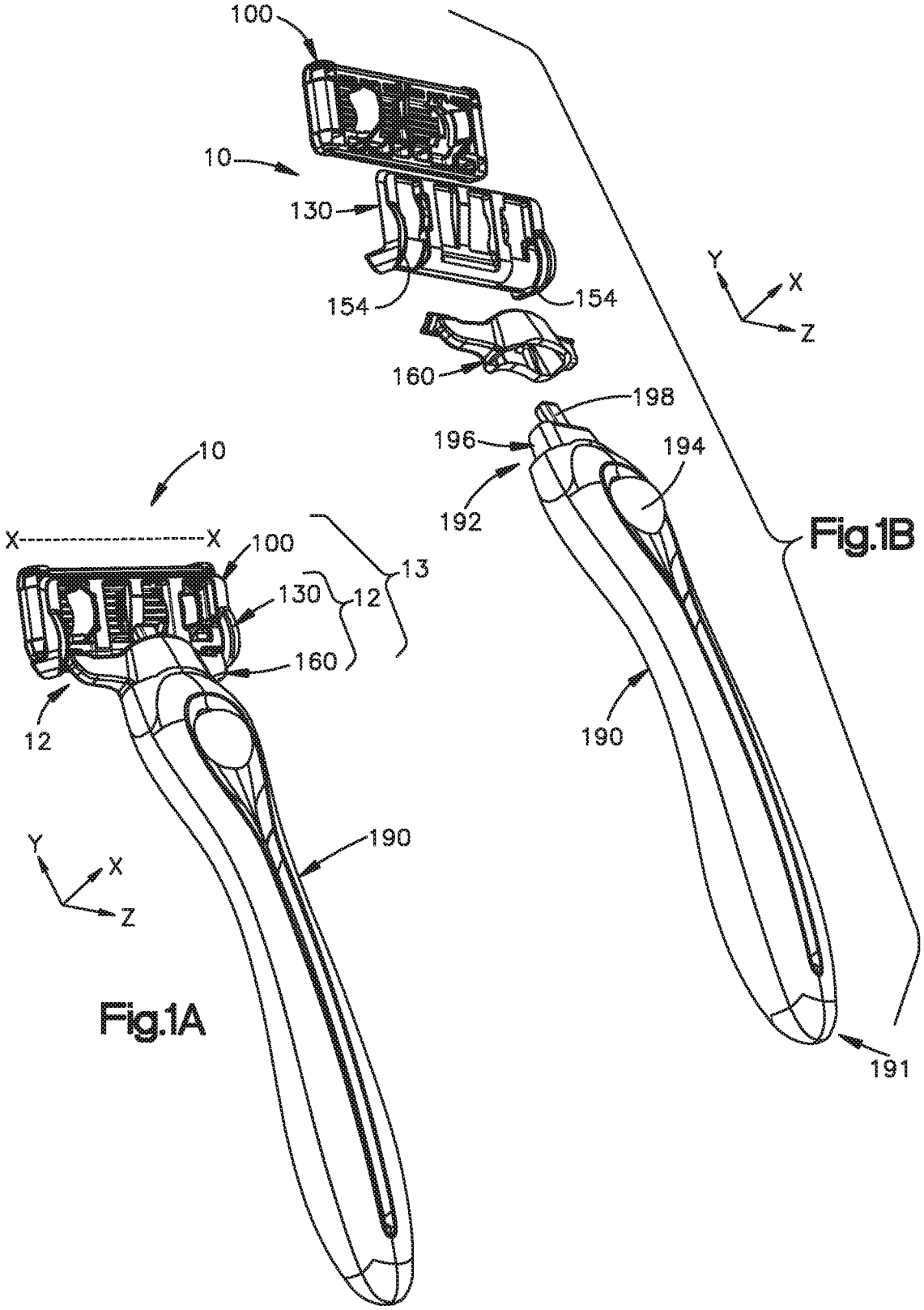
FIG. 1A is a diagram illustrating a perspective view of a shaving razor with a handle, a first example of a head converter, and a blade unit.
FIG. 1B is a diagram illustrating an exploded, perspective view of the shaving razor of FIG. 1A.

It is to be understood that the present concept is not limited in its application to the details of construction and to the examples of the components set forth in the following description or illustrated in the drawings. The figures and written description are provided to teach any person skilled in the art to make and use the inventions for which patent protection is sought. The present concept is capable of other examples and of being practiced and carried out in various ways. Persons of skill in the art will appreciate that the development of an actual commercial example incorporating aspects of the present concept will require numerous implementations—specific decisions to achieve the ultimate goal of the developer for the commercial example. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present concept or the appended claims. Further, it should be understood that any one of the features of the present concept may be used separately or in combination with other features. Other systems, methods, features, and advantages of the present concept will be, or become, apparent to one with skill in the art upon examination of the figures and the detailed description. It is intended that all such additional systems, methods, features, and advantages be included within this description, be within the scope of the present concept, and be protected by the accompanying claims.

Further, any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 3 mm includes all values from 1 mm to 9 mm, and approximately 50 degrees includes all values from 16.6 degrees to 150 degrees.

Further, as the present concept is susceptible to examples of many different forms, it is intended that the present disclosure be considered as an example of the principles of the present concept and not intended to limit the present concept to the specific examples shown and described. Any one of the features of the present concept may be used separately or in combination with any other feature. References to the terms "example," "embodiments," and/or the like in the description mean that the feature and/or features being referred to are included in, at least, one aspect of the description. Separate references to the terms "example," "embodiments," and/or the like in the description do not necessarily refer to the same example and are also not mutually exclusive unless so stated and/or except as will be readily apparent to those skilled in the art from the description. For example, a feature, structure, process, step, action, or the like described in one example may also be included in other examples, but is not necessarily included. Thus, the present concept may include a variety of combinations and/or integrations of the examples described herein. Additionally, all aspects of the present disclosure, as described herein, are not essential for its practice. Likewise, other systems, methods, features, and advantages of the present concept will be, or become, apparent to one with skill in the art upon examination of the figures and the description. It is intended that all such additional systems, methods, features, and advantages be included within this description, be within the scope of the present concept, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

FIGS. 1A-1B illustrate a shaving razor 10 which includes a handle 190 coupled with a shaving head 13. The shaving head 13 includes a blade unit 100 and a head converter 12. The head converter 12 includes a frame 130 and an interconnecting member 160. In at least one example, the frame 130 may be configured to removably couple with the blade unit 100. In other examples, the frame 130 may be fixedly coupled with the blade unit 100. The frame 130 may be pivotably coupled with the interconnecting member 160, and the interconnecting member 160 may be configured to be coupled with the handle 190. The frame 130 may be fixedly coupled with the interconnecting member 160. In other examples, the frame 130 may be removably coupled with the interconnecting member 160. In yet other examples, the head converter 12 may not include an interconnecting member 160 such that the frame 130 may be directly coupled with the handle 190.

The handle 190 extends in a handle direction along the Y-axis between a proximal end 191 and a distal end 192. The shaving head 13 may be coupled with the distal end 192 of the handle 190. In at least one example, the shaving head 13 may be removably coupled with the handle 190, for example, by a lock and release mechanism. In other examples, the shaving head 13 may be fixedly coupled with the handle 190 such that the shaving head 13 is not configured to be removably coupled with or selectively separated from the handle 190. The handle 190 may be operable to pivot relative to the shaving head 13. In other examples, the handle 190 may be secured to the shaving head 13 in a fixed relationship such that the shaving head 13 is not operable to pivot relative to the handle 190. The handle 190 may be any suitable shape to allow a user to securely grip the handle 190. The handle 190 may include one continuous curve or include one straight portion or several curved and/or straight portions extending along an entirety of or a substantial portion of the handle 190 without deviating from the scope of the present concept. The handle 190 may include a button 194 which may also function as a finger rest area. The button 194, as illustrated in FIGS. 1A and 1B may be spherical, but can be any suitable shape to function as a button or a finger rest area. The handle 190 may also include a connecting portion 196. The connecting portion 196 may be configured to connect the handle 190 with the shaving head 13. The connecting portion 196 may include a biasing member 198. The biasing member 198 abuts the shaving head 13 to bias the shaving head 13 in a pivotal direction. The biasing member 198 may include a spring such that when the shaving head 13 incurs an external force to pivot, the spring compresses but exerts a force against the external force such that if the external force is removed, the shaving head 13 pivots back to a resting position.

Figure 2:
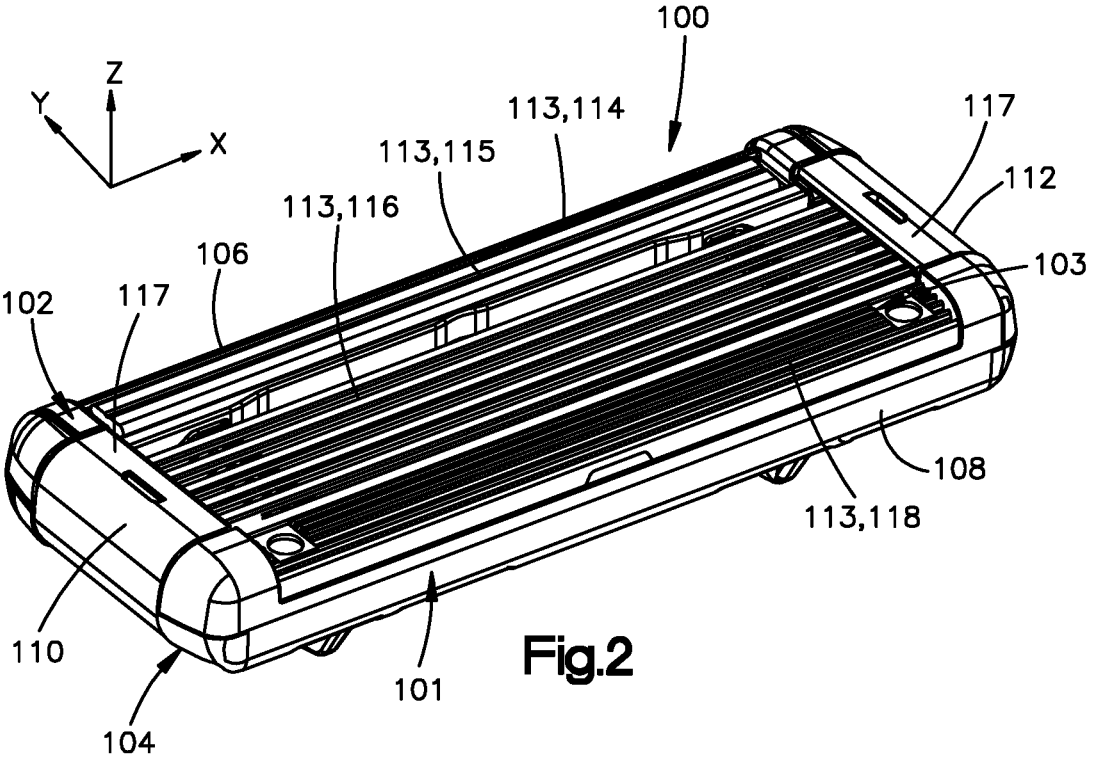
FIG. 2 is a diagram illustrating a perspective view of the blade unit of FIG. 1A.

As illustrated in FIG. 2, the blade unit 100 includes a housing 101. The housing 101 extends along a longitudinal axis X-X. The housing 101, as illustrated, has a substantially rectangular shape, but may be any suitable shape such as ovoid or circular without deviating from the scope of the present concept. The blade unit 100 and the housing 101 may include a top side 102 and a bottom side 104 opposite the top side 102. The bottom side 104 is proximate to the handle 190, and the top side 102 includes at least one skin contacting area 103. The housing 101 includes first and second longitudinal walls 106, 108. Each of the first and second longitudinal walls 106, 108 may extend longitudinally along the longitudinal axis X-X between the top and bottom sides 102, 104 and in a direction Z of the housing 101. The first and second longitudinal walls 106, 108, as illustrated, extend substantially parallel to each other. First and second side walls 110, 112 may extend substantially parallel to each other and between the first and second longitudinal walls 106, 108 along a direction Y of the housing 101. The first and second side walls 110, 112 also extend between the top and bottom sides 102, 104 along the direction Z of the housing 101. The housing 101 may be made of plastic, metal, another suitable material, or any combination thereof without deviating from the scope of the present concept.

The blade unit 100 includes a plurality of components 113 which assist and contribute to the shaving experience of the user. One of the plurality of components 113 may include a plurality of blades 116 disposed and retained within the housing 101. The plurality of blades 116 extend along the longitudinal axis X-X. In at least one example, the blade unit 100 can include one, two, three, four, or more of the blades 116 without deviating from the scope of the present concept. The plurality of blades 116 may be movably disposed or freely mounted, in the housing 101. For example, the plurality of blades 116 may be coupled with elastic fingers which extend from the housing 101. In other examples, the plurality of blades 116 may be fixedly disposed in the housing 101.

The plurality of components 113 of the blade unit 100 may also include a cap 114, a lubricating strip 115, and a guard bar 118 disposed on and/or retained within the blade unit 100. The cap 114 may be coupled with the first longitudinal wall 106. The lubricating strip 115 may be disposed on the top side 102 of the cap 114 to deliver a friction reduction effect, an anti-irritation effect, and/or provide lubrication after shaving. The guard bar 118 may be coupled with the second longitudinal wall 108 opposite the cap 114 to stretch the skin during shaving or dispense the forces applied to the skin, thereby causing the blade unit 100 to glide across the skin while providing a closer shave. The cap 114, the lubricating strip 115, and the guard bar 118 each extend along the longitudinal axis X-X. Additional components, e.g., a cover and/or one or more trimming blades, may also be included on and retained within the blade unit 100 without deviating from the scope of the present concept.

One or more of the plurality of components 113 may be retained within or on the blade unit 100 by retainers 117. For example, the retainers 117 may be operable to retain the plurality of blades 116, the cap 114, the lubricating strip 115, and/or the guard bar 118 on or within the blade unit 100. As illustrated, the retainers 117 retain the components 113 by securely abutting and partially covering (i) a portion of the plurality of components, for example lateral sides, or ends of the plurality of components 113 along the direction X, and (ii) the side walls 110, 112. The retainers 117 may be operable to secure one or more other components within or on the blade unit 100 without deviating from the scope of the present concept. One or more of the components 113 may also be secured to the blade unit 100 without the retainers 117, for example via other means, without deviating from the scope of the present concept.

Figure 3A:
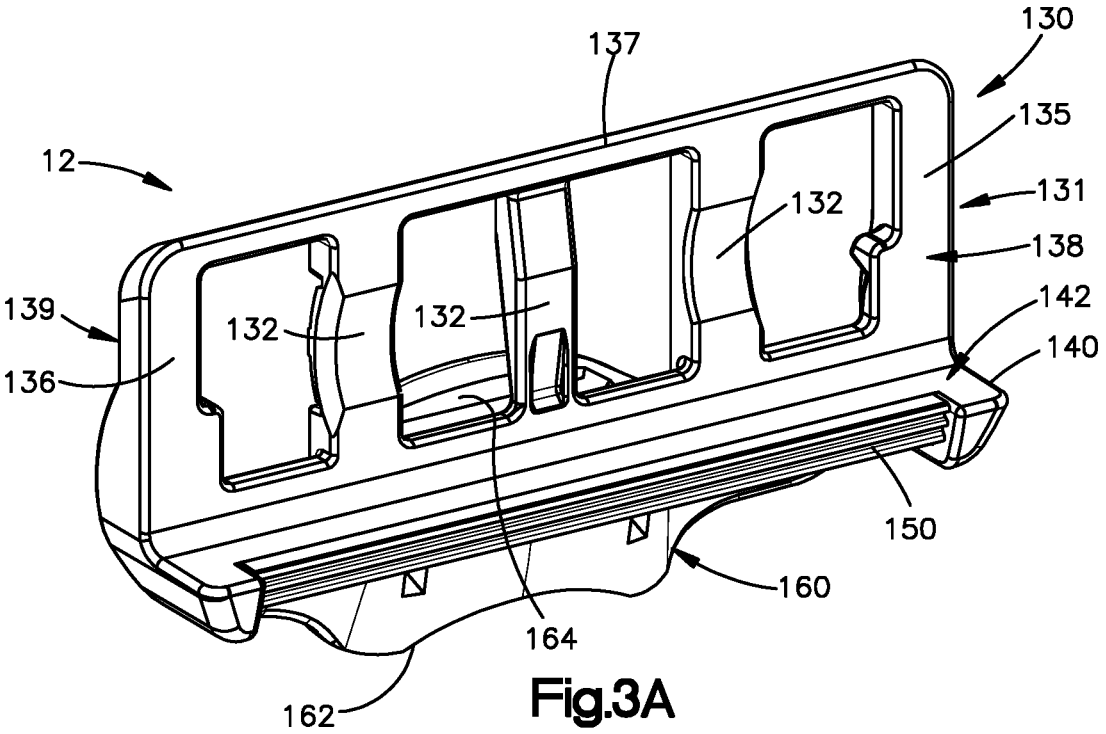
FIG. 3A is a diagram illustrating a top, perspective view of the head converter of FIG. 1A with a frame and an interconnecting member.
Figure 3B:
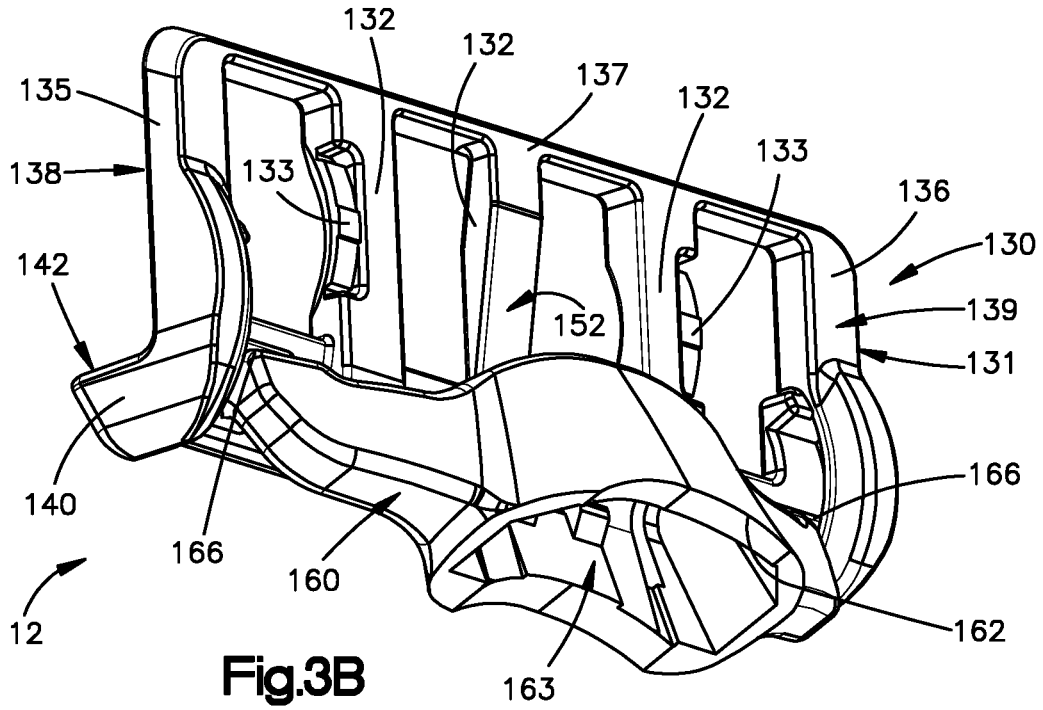
FIG. 3B is a diagram illustrating a bottom, perspective view of the head converter of FIG. 1A with a frame and an interconnecting member.

The blade unit 100 may be configured to be removably coupled with a head converter 12, which is illustrated in FIGS. 3A, 3B, 4A, and 4B. The head converter 12 includes a frame 130 and an interconnecting member 160 which is pivotably coupled with the frame 130. The frame 130 includes a housing 131 that extends along the longitudinal axis X-X. The housing 131 also includes two sides 135, 136 which extend along the Y direction and which may function as support for the blade unit 100. The frame 130 may also include one or more supports 132 which extend from the housing 131. The supports 132 may be configured to assist in providing support to the bottom side 104 of the blade unit 100. The supports 132 may be provided between the two sides 135, 136 and, as illustrated, may extend from the housing 131 along the Y direction, substantially parallel with the two sides 135, 136. However, the supports 132 may also be provided in the frame 130 along the longitudinal axis X-X, extending between the two sides 135, 136 or in any other desired orientation without deviating from the scope of the present concept, so long as the supports 132, along with the frame 130, provide support to the blade unit 100. As illustrated in FIGS. 3A and 3B, three supports 132 are provided, but more or less supports 132 may be provided as desired.

The housing 131 of the frame 130 may also, as in FIGS. 3A-4, include a top bar 137 which extends along the longitudinal axis X-X. The top bar 137 may span between the two sides 135, 136 to create the substantially rectangular frame 130. The top bar 137, as illustrated, may also connect the supports 132. In other examples, the top bar 137 may not be connected to the supports 132.

The frame 130 may include a top side 138 and a bottom side 139 opposite the top side 138. The top side 138 of the frame 130 abuts and supports the bottom side 104 of the blade unit 100. Along the bottom side 139, as illustrated in FIG. 3B, two of the supports 132 include a coupling structure 133. The coupling structure 133 may be configured to interact with corresponding hooks 120 (shown in FIG. 4) on the blade unit 100 such that the blade unit 100 may be removably coupled with the frame 130. Different and/or additional methods of removably coupling the blade unit 100 with the frame 130 may be provided without deviating from the scope of the present concept. When the blade unit 100 is removably coupled to the frame 130, the blade unit 100 may be exchanged when dull or as desired without having to purchase and provide an entirely new shaver head or shaving razor. Accordingly, being able to remove separately the blade unit 100 provides a lower-priced option. Also, the frame 130 and the head converter 12 may be used in conjunction with different blade units 100 and handles 190 to provide customization as desired. In other examples, the blade unit 100 may be fixedly coupled with the frame 130 such that the blade unit 100 may not be removably coupled with the frame 130.

A seat 140 may extend along the top side 138 of the frame 130. The seat 140 extends from the frame 130 such that the blade unit 100 may be connected to the frame 130 by sitting the blade unit 100 in the frame 130 and the seat 140. The seat 140 may extend from the frame 130 in the Z direction. As illustrated, the seat 140 may be substantially perpendicular to the frame 130; however the seat 140 may foreseeably extend from the frame 130 at any desired angle without deviating from the scope of the present concept. The seat 140 may include a seat surface 142 on which the second longitudinal wall 108 of the blade unit 100 may be received. For example, the blade unit 100 sits in the head converter 12 while abutting the top side 138 of the frame 130 and the seat surface 142 of the seat 140.

The seat 140 may include a top surface 150. The top surface 150 of the seat 140 provides customization to the shaving head 13. For example, the top surface 150 of the seat 140 may function as a lubricant, as a guard bar, to provide glide assistance, and/or any other desired function. As such, the top surface 150 of the seat 140 may allow for a new or extra function for the blade unit 100 without the user having to purchase an entirely new shaving head. Further, the seat 140, in function, may provide an extended wall for the blade unit 100. Accordingly, the skin contact surface of the shaving head 13 may be expanded. Also, the angle that the skin contacts the seat 140 may be different than that of the second longitudinal wall 108 of the blade unit 100.

Figure 4A:
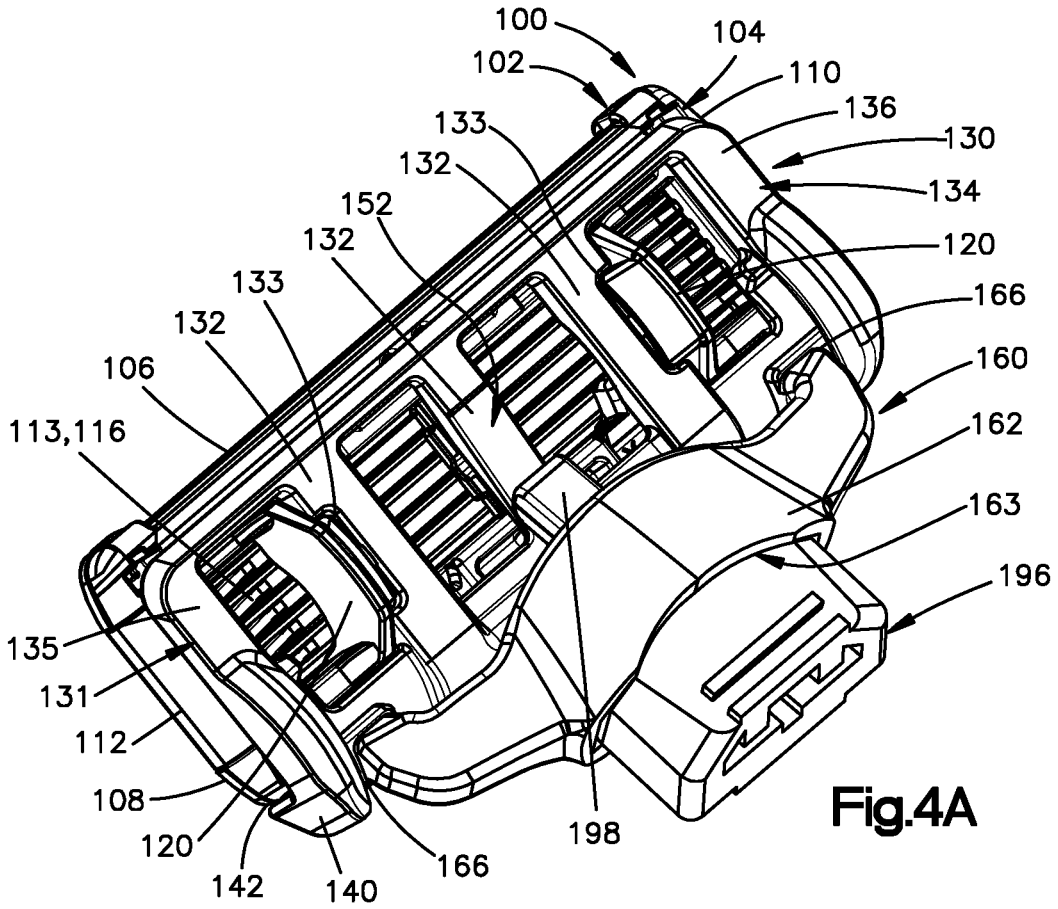
FIG. 4A is a diagram illustrating a bottom, perspective view of the head converter of FIG. 1A coupled with the blade unit and a portion of the handle.
Figure 4B:
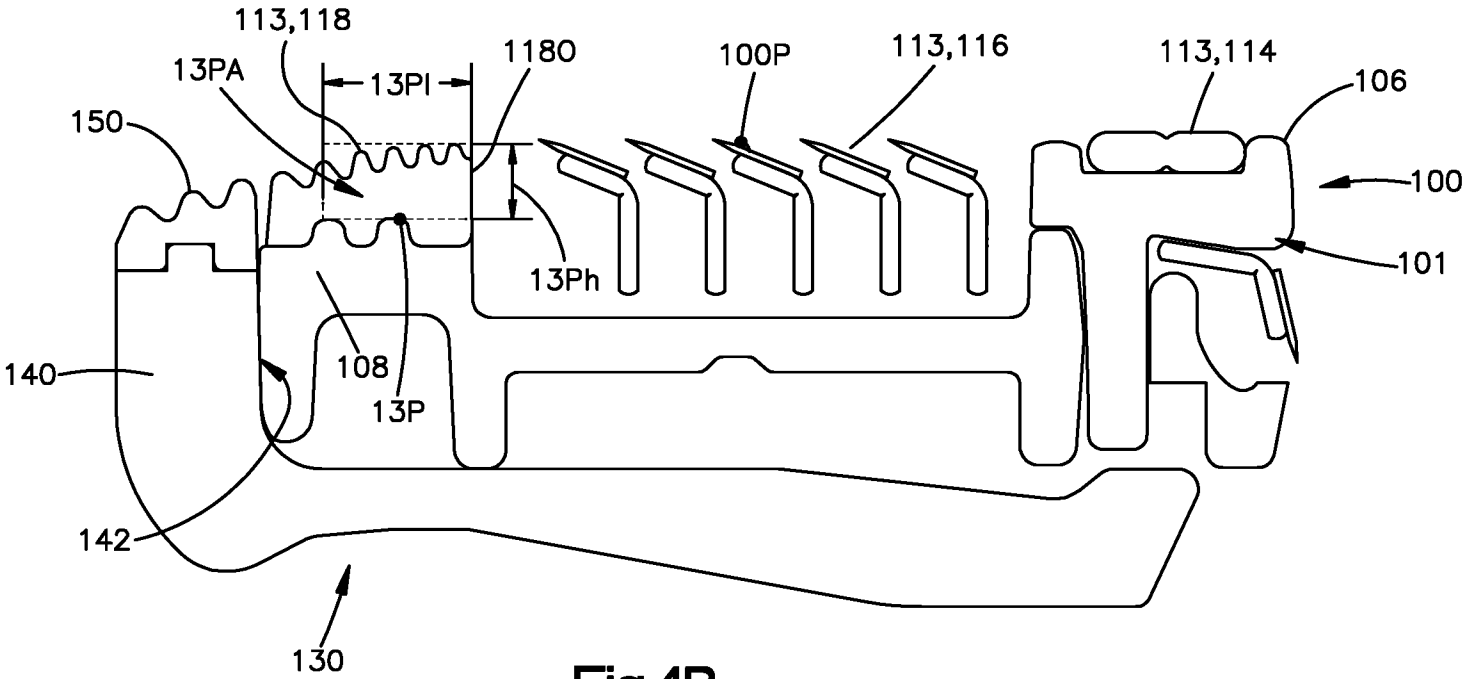
FIG. 4B is a diagram illustrating a cross-sectional view of the frame coupled with the blade unit.

As illustrated in FIG. 4B, the blade unit 100, without a head converter 12, pivots about a first pivot axis 100P. For example, the first pivot axis 100P may be located approximately at the middle of the distance between the guard bar 118 and the cap 114, and may be parallel to the edges of the blades 116 and the longitudinal axis X-X. However, when the blade unit 100 is coupled with the head converter 12, the shaving head 13 pivots about a second pivot axis 13P which may be parallel to the longitudinal axis X-X. The first pivot axis 100P and the second pivot axis 13P may be different. The second pivot axis 13P may be located for example, out of the area of the blades 116, in an area 13PA. Area 13PA may be in front of the blades 116 and within the area of the guard bar 118. Area 13PA may have a length 13PI from a beginning surface 1180 of the guard bar 118 and a height 13Ph from the top side 102. Area 13PA, as shown in a cross-sectional view as in FIG. 4B, may have a substantially rectangular shape, but in other examples may be any suitable shape, such as an oval, circle, square, or triangle. The length 13PI may be about 2 mm from the beginning surface 1180 of the guard bar 118 and the height 13Ph may be about 1 mm from the top side 102. In at least one example, the second pivot axis 13P may be about 0.5 times the length 13PI and the height 13Ph. For example, as illustrated in FIG. 4B, the second pivot axis 13P may be about 1 mm from the beginning surface 1180 of the guard bar 118 and about 1 mm from the top side 102. With the pivot axis location out of the area of the blades 116, the force that is applied during shaving by the user may be absorbed, as the force is not applied on the blades 116, resulting in a less aggressive shaving experience. As such, the head converter 12 may provide a customized and more precise and comfortable shaving experience for the user.

When the blade unit 100 is coupled with the head converter 12 or frame 130, the blade unit 100 may be substantially immovable. For example, the blade unit 100 substantially does not move separately from the frame 130 when seated within the frame 130 and the seat 140 and connected with the coupling structure 133 and hooks 120. Also along the bottom side 139 of the frame 130, at least one of the supports 132 may include a camming surface 152. The camming surface 152 of the frame 130 abuts the biasing member 198 of the handle 190 such that the frame 130 and the blade unit 100 pivot together without separate movement.

While the frame 130, as illustrated, may be substantially rectangular, the shape of the frame 130 may be different shapes, such as ovoid or circular, without deviating from the scope of the present concept. The frame 130 can be made with any moldable material such as metal, plastic or glass, or other materials such as wood or any combination thereof.

The interconnecting member 160 may be pivotably coupled with the frame 130. The interconnecting member 160 may include a plurality of attachment components 166 which correspond with two depressions 154 (shown in FIG. 1B) formed in the bottom side 139 of the frame 130 such that the interconnecting member 160 is pivotably coupled with the frame 130. In at least one example, the attachment components 166 may be shell bearings. Other methods of pivotably coupling the interconnecting member 160 and the frame 130 may be provided without deviating from the scope of the present concept.

The interconnecting member 160 includes a housing 162. The housing 162 may have a recessed portion 163 which may be configured to receive a connecting portion 196 of the handle 190. As such, the connecting portion 196 may be inserted into the recessed portion 163 to provide coupling of the interconnecting member 160 and the handle 190. The interconnecting member 160 may also include an aperture 164 through which the biasing member 198 of the handle 190 can extend to interact with the frame 130. The aperture 164 may be in communication with the recessed portion 163 of the interconnecting member 160. However, the handle 190 may be coupled with the interconnecting member 160 to interact with the frame 130 in other ways without deviating from the present concept, so long as the handle 190 is coupled with the head converter 12, and the biasing member 198 interacts with the shaving head 13.

Figures 5A, 5B:
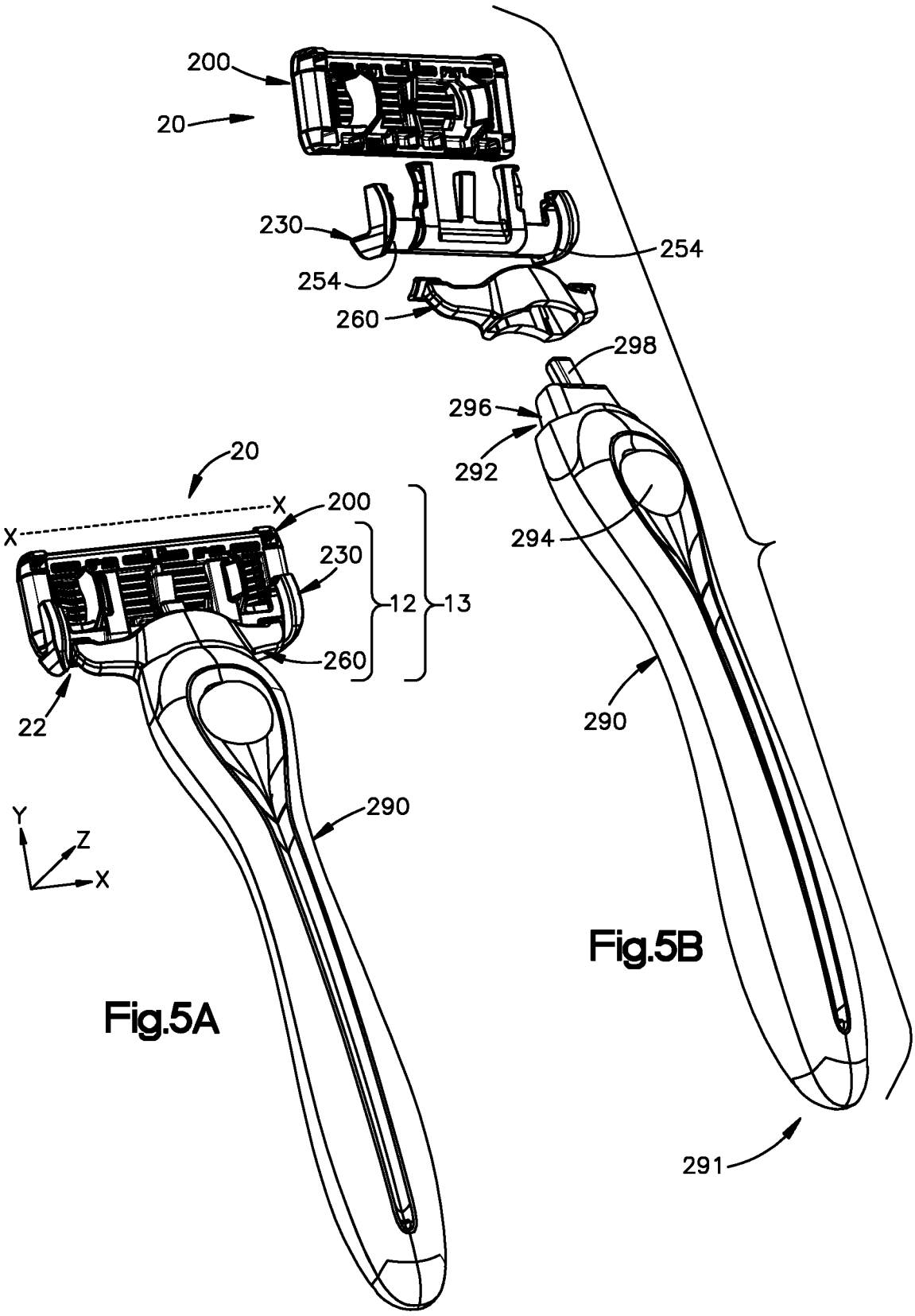
FIG. 5A is a diagram illustrating a perspective view of a shaving razor with a handle, a second example of a head converter, and a blade unit.
FIG. 5B is a diagram illustrating an exploded, perspective view of the shaving razor of FIG. 5A.

FIGS. 5A-5B illustrates another example of a shaving razor 20 which includes a handle 290 coupled with a shaving head 23. The shaving head 23 includes a blade unit 200 and a head converter 22. The head converter 22 includes a frame 230 and an interconnecting member 260. In at least one example, the frame 230 may be configured to removably couple with the blade unit 200. In other examples, the frame 230 may be fixedly coupled with the blade unit 200. The frame 230 may be pivotably coupled with the interconnecting member 260, and the interconnecting member 260 may be configured to be coupled with the handle 290. The frame 230 may be fixedly coupled with the interconnecting member 260. In other examples, the frame 230 may be removably coupled with the interconnecting member 260. In yet other examples, the head converter 22 may not include an interconnecting member 260 such that the frame 230 is directly coupled with the handle 290.

The handle 290 extends in a handle direction along the Y-axis between a proximal end 291 and a distal end 292. The shaving head 23 is coupled with the distal end 292 of the handle 290. In at least one example, the shaving head 23 may be removably coupled with the handle 290, for example, by a lock and release mechanism. In other examples, the shaving head 23 may be fixedly coupled with the handle 290 such that the shaving head 23 is not configured to be removably coupled with or selectively separated from the handle 290. The handle 290 may be operable to pivot relative to the shaving head 23. In other examples, the handle 290 may be secured to the shaving head 23 in a fixed relationship such that the shaving head 23 is not operable to pivot relative to the handle 290. The handle 290 may be any suitable shape to allow a user to securely grip the handle 290 The handle 290 may include one continuous curve or include one straight portion or several curved and/or straight portions extending along an entirety of or a substantial portion of the handle 290 without deviating from the scope of the present concept. The handle 290 may include a button 294 which may also function as a finger rest area. The button 294, as illustrated in FIGS. 5A and 5B may be spherical, but may be any suitable shape to function as a button or a finger rest area. The handle 290 also includes a connecting portion 296. The connecting portion 296 may be configured to connect the handle 290 with the shaving head 23. The connecting portion 296 includes a biasing member 298. The biasing member 298 abuts the shaving head 23 to bias the shaving head 23 in a pivotal direction. The biasing member 298 may include a spring such that when the shaving head 23 incurs an external force to pivot, the spring compresses but exerts a force against the external force such that if the external force is removed, the shaving head 23 pivots back to a resting position.

Figure 6:
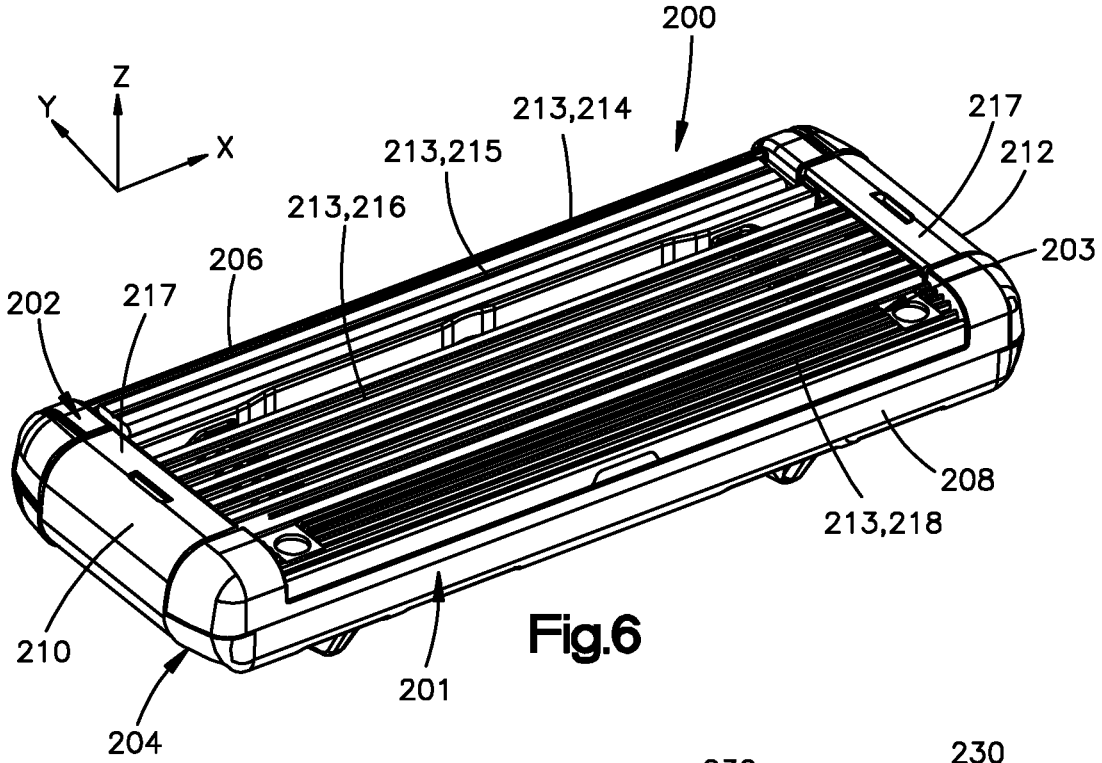
FIG. 6 is a diagram illustrating a perspective view of the blade unit of FIG. 5A.

As illustrated in FIG. 6, the blade unit 200 includes a housing 201. The housing 201 extends along a longitudinal axis X-X. The housing 201, as illustrated, may have a substantially rectangular shape, but may be any suitable shape such as ovoid or circular without deviating from the scope of the present concept. The blade unit 200 and the housing 201 include a top side 202 and a bottom side 204 opposite the top side 202. The bottom side 204 is proximate to the handle 290, and the top side 202 includes at least one skin contacting area 203. The housing 201 includes first and second longitudinal walls 206, 208. Each of the first and second longitudinal walls 206, 208 extends longitudinally along the longitudinal axis X-X between the top and bottom sides 202, 204 and in a direction Z of the housing 201. The first and second longitudinal walls 206, 208, as illustrated, extend substantially parallel to each other. First and second side walls 210, 212 extend substantially parallel to each other and between the first and second longitudinal walls 206, 208 along a direction Y of the housing 201. The first and second side walls 210, 212 also extend between the top and bottom sides 202, 204 along the direction Z of the housing 201. The housing 201 may be made of plastic, metal, another suitable material, or any combination thereof without deviating from the scope of the present concept.

The blade unit 200 may include a plurality of components 213 which assist and contribute to the shaving experience of the user. One of the plurality of components 213 may be a plurality of blades 216 disposed and retained within the housing 201. The blades 216 extend along the longitudinal axis X-X. In at least one example, the blade unit 200 may include one, two, three, four, or more of the blades 216 without deviating from the scope of the present concept. The plurality of blades 216 may be movably disposed or freely mounted, in the housing 201. For example, the plurality of blades 216 may be coupled with elastic fingers which extend from the housing 201. In other examples, the plurality blades 216 may be fixedly disposed in the housing 201.

The plurality of components 213 of the blade unit 200 may also include a cap 214, a lubricating strip 215, and a guard bar 218 disposed on and/or retained within the shaving head 23. The cap 214 is coupled with the first longitudinal wall 206. The lubricating strip 215 may be disposed on the top side 202 of the cap 214 to deliver a friction reduction effect, an anti-irritation effect, and/or provide lubrication after shaving. The guard bar 218 is coupled with the second longitudinal wall 208 opposite the cap 214 to stretch the skin during shaving or dispense the forces applied to the skin, thereby causing the blade unit 200 to glide across the skin while providing a closer shave. The cap 214, the lubricating strip 215, and the guard bar 218 each extend along the longitudinal axis X-X. Additional components, e.g., a cover and/or one or more trimming blades, may also be included on and retained within the blade unit 200 without deviating from the scope of the present concept.

One or more of the plurality of components 213 may be retained within or on the blade unit 200 by retainers 217. For example, the retainers 217 may be operable to retain the blades 216, the cap 214, the lubricating strip 215, and/or the guard bar 218 on or within the blade unit 200. As illustrated, the retainers 217 retain the plurality of components 213 by securely abutting and partially covering (i) a portion of the plurality of components 213, for example lateral sides, or ends of the plurality of components 213 along the direction X, and (ii) the side walls 210, 212. The retainers 217 may be operable to secure one or more other components within or on the blade unit 200 without deviating from the scope of the present concept. one or more of the components 213 may be secured to the blade unit 200 without the retainers 217, for example via other means, without deviating from the scope of the present concept.

Figure 7A:
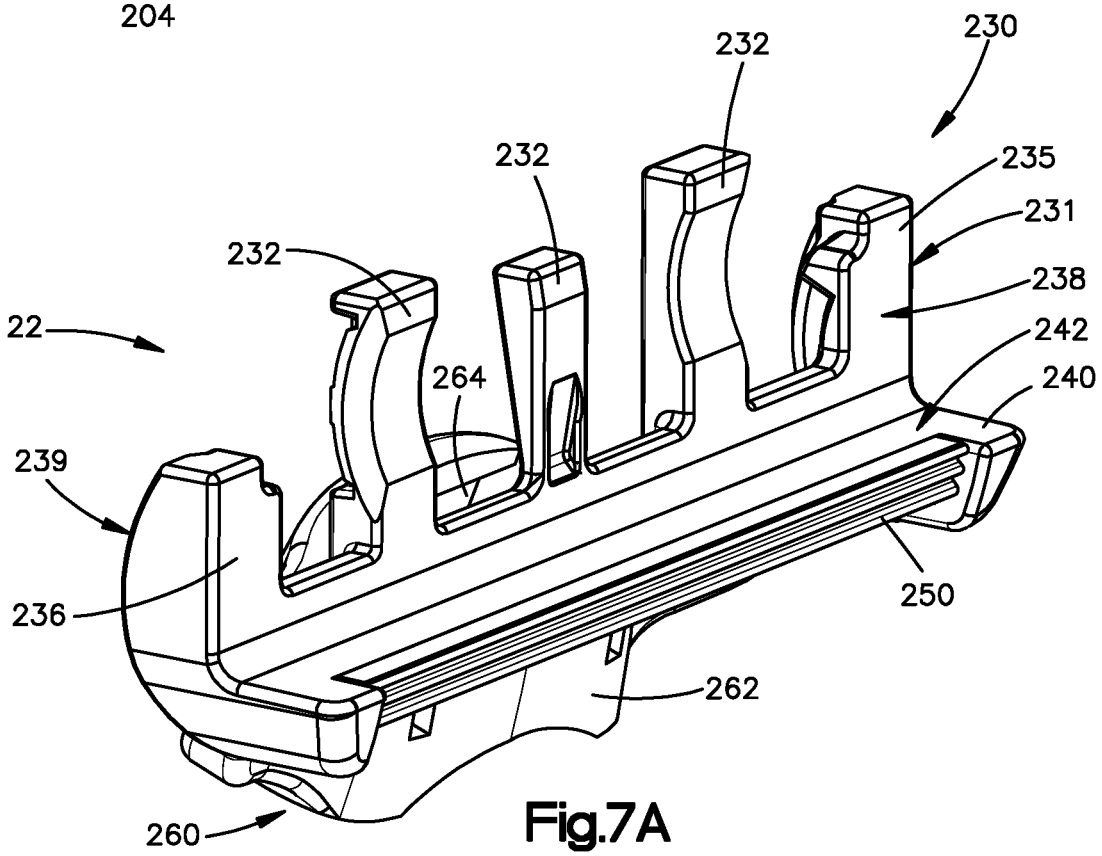
FIG. 7A is a diagram illustrating a top, perspective view of the head converter of FIG. 5A with a frame and an interconnecting member.
Figure 7B:
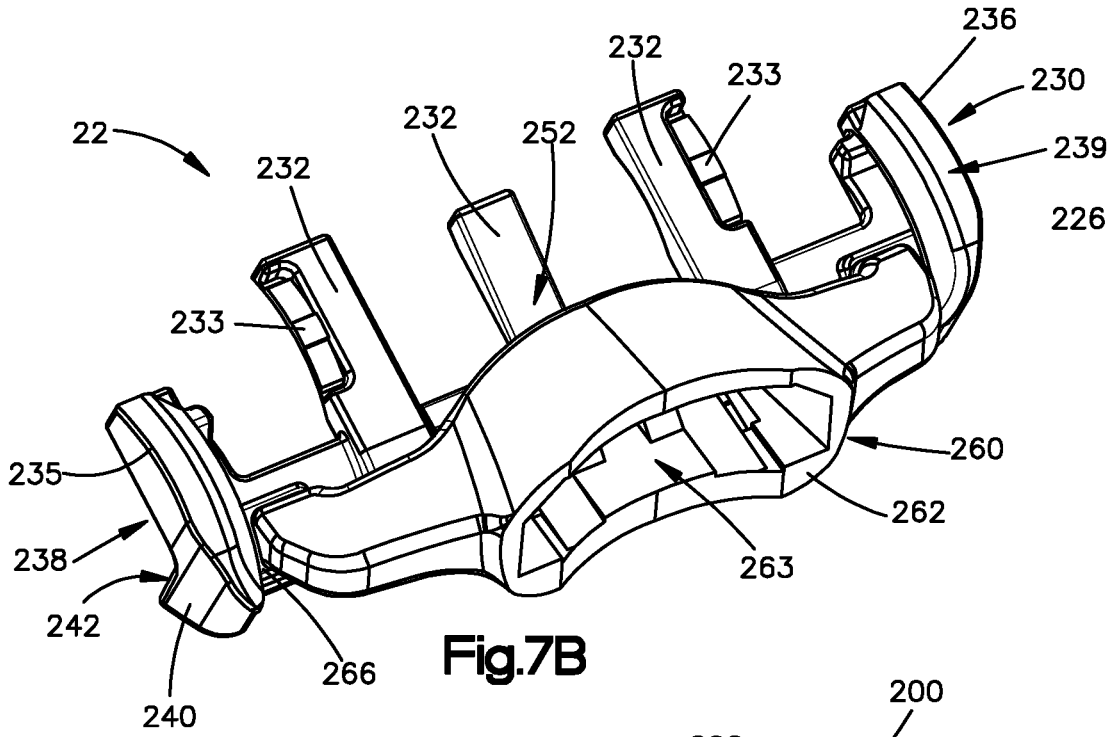
FIG. 7B is a diagram illustrating a bottom, perspective view of the head converter of FIG. 5A with a frame and an interconnecting member.

The blade unit 200 may be configured to be removably coupled with a head converter 22, which is illustrated in FIGS. 7A, 7B, 8A, and 8B. The head converter 22 may include a frame 230 and an interconnecting member 260 which is pivotably coupled with the frame 230. The frame 230 includes a housing 231 that extends along the longitudinal axis X-X. The housing 231 may also include two sides 235, 236 which extend along the Y direction which may function as support for the blade unit 200. The frame 230 may also include one or more supports 232 which extend from the housing 231. The supports 232 may be configured to assist in providing support to the bottom side 204 of the blade unit 200. The supports 232 are provided between the two sides 235, 236. The supports 232, as illustrated, extend from the housing 231 along the Y direction, substantially parallel with the two sides 235, 236. However, the supports 232 may be provided in the frame 230 along the longitudinal axis, extending between the two sides 235, 236 or in any other desired orientation without deviating from the scope of the present concept, so long as the supports 232, along with the frame, provide support to the blade unit 200. As illustrated in FIGS. 7A and 7B, three supports 232 are provided, but more or less supports 232 may be provided as desired.

In the example illustrated in FIGS. 5A-8, the housing 231 of the frame 230 does not include a top bar which extends along the longitudinal axis X-X that spans between the two sides 235, 236 and creates a substantially rectangular frame 230. As such, the two sides 235, 236 and the supports 232 may not be connected, which may decrease the amount of material needed and also decrease the cost of production of the head converter 22.

The frame 230 has a top side 238 and a bottom side 239 opposite the top side 238. The top side 238 of the frame 230 abuts and supports the bottom side 204 of the blade unit 200. Along the bottom side 239, as illustrated in FIG. 7B, two of the supports 232 may include a coupling structure 233. The coupling structure 233 may be configured to interact with corresponding hooks 220 (shown in FIG. 8) on the blade unit 200 such that the blade unit 200 may be removably coupled with the frame 230. Different and/or additional methods of removably coupling the blade unit 200 with the frame 230 may be provided without deviating from the scope of the present concept. When the blade unit 200 is removably coupled to the frame 230, the blade unit 200 may be exchanged when dull or as desired without having to purchase and provide an entirely new shaver head or shaving razor. Accordingly, being able to remove separately the blade unit 200 provides a lower-priced option. Also, the frame 230 and the head converter 22 may be used in conjunction with different blade units 200 and handles 290 to provide customization as desired. In other examples, the blade unit 200 may be fixedly coupled with the frame 230 such that the blade unit 200 is not removably coupled with the frame 230.

A seat 240 may extend along the top side 238 of the frame 230. The seat 240 extends from the frame 230 such that the blade unit 200 may be connected to the frame 230 by sitting in the frame 230 and the seat 240. The seat 240 extends from the frame 230 in the Z direction. As illustrated, the seat 240 may be substantially perpendicular to the frame 230; however, the seat 240 may also extend from the frame 230 at any desired angle without deviating from the scope of the present concept. The seat 240 may have a seat surface 242 on which the second longitudinal wall 208 of the blade unit 200 may be received. For example, the blade unit 200 may sit in the head converter 22 while abutting the top side 238 of the frame 230 and the seat surface 242 of the seat 240.

The seat 240 includes a top surface 250. The top surface 250 of the seat 240 may provide customization to the shaving head 23. For example, the top surface 250 of the seat 240 may function as a lubricant, as a guard bar, to provide glide assistance, and/or any other desired function. As such, the top surface 250 of the seat 240 may allow for a new or extra function for the blade unit 200 without the user having to purchase an entirely new shaving head. Further, the seat 240, in function, may provide an extended wall for the blade unit 200. Accordingly, the skin contact surface of the shaving head 23 may be expanded. Also, the angle that the skin contacts the seat 240 may be different than that of the second longitudinal wall 208 of the blade unit 200.

Figure 8A:
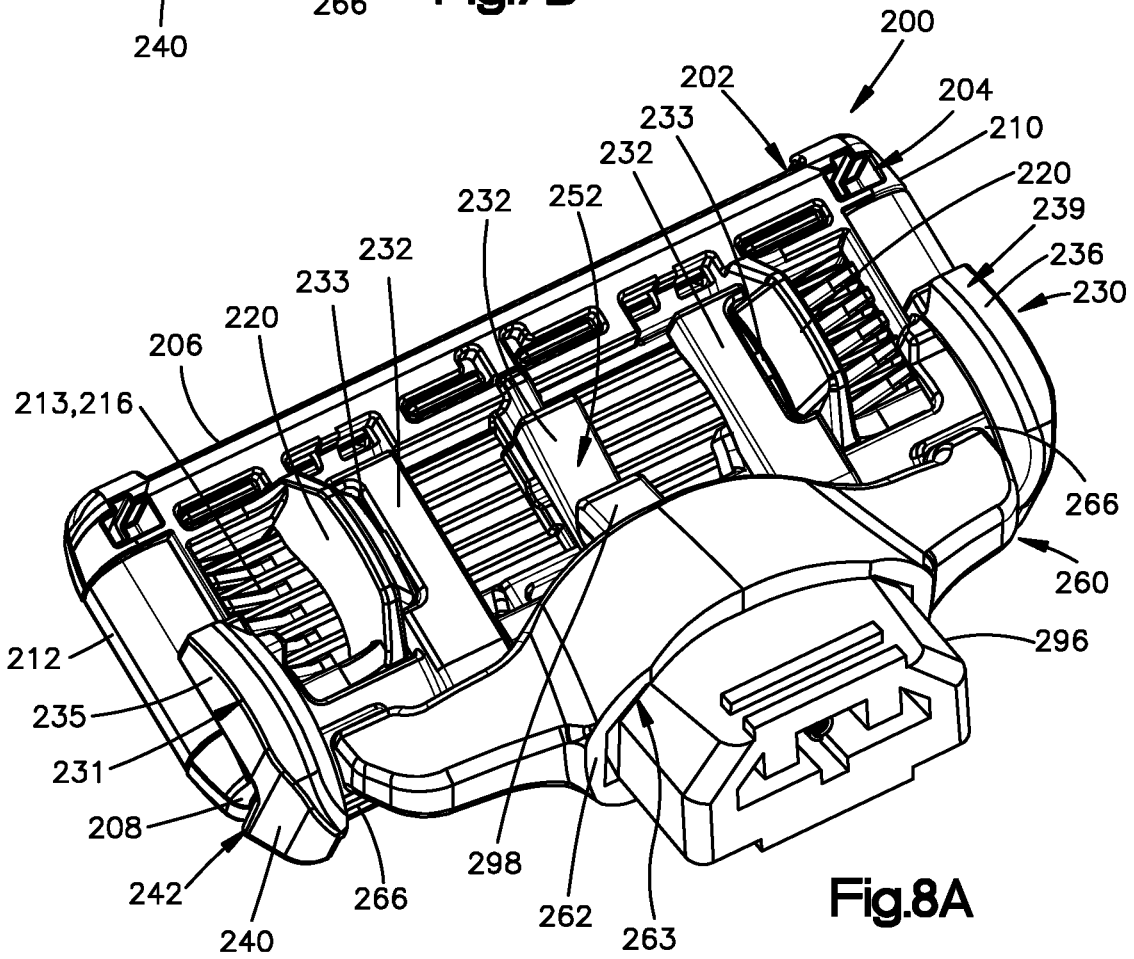
FIG. 8A is a diagram illustrating a bottom, perspective view of the head converter of FIG. 5A coupled with the blade unit and a portion of the handle.
Figure 8B:
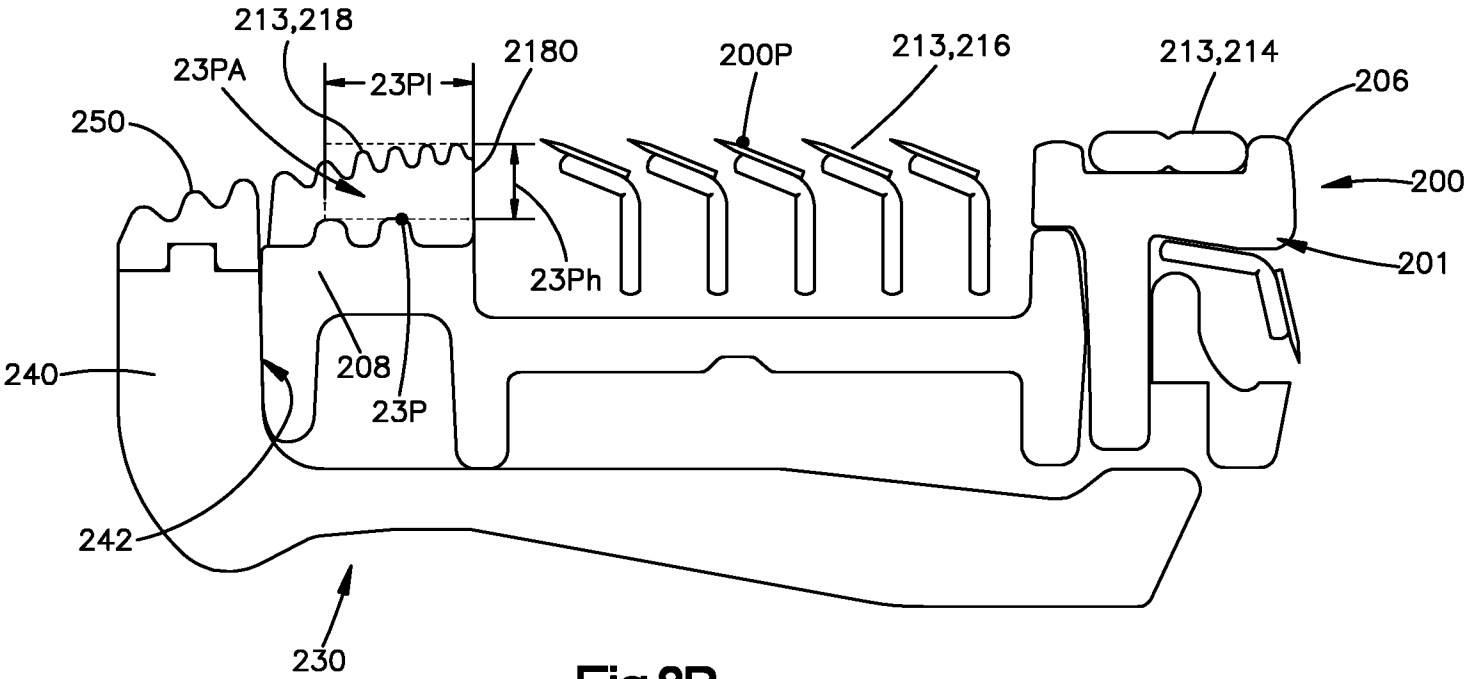
FIG. 8B is a diagram illustrating a cross-sectional view of the frame coupled with the blade unit.

As illustrated in FIG. 8B, the blade unit 200, without a head converter 22, pivots about a first pivot axis 200P. For example, the first pivot axis 200P may be located approximately at the middle of the distance between the guard bar 218 and the cap 214, which may be parallel to the edges of the blades 216 and the longitudinal axis. However, when the blade unit 200 is coupled with the head converter 22, the shaving head 23 may pivot about a second pivot axis 23P which may be parallel to the longitudinal axis. The first pivot axis 200P and the second pivot axis 23P may be different. The second pivot axis 23P may be located in an area 23PA, for example, out of the area of the blades 216. Area 23PA may be in front of the blades 216 and within the area of the guard bar 218. Area 23PA has a length 23PI from a beginning surface 2180 of the guard bar 218 and a height 23Ph from the top side 202. Area 23PA, as shown in a cross-sectional view as in FIG. 8B, may have a substantially rectangular shape, but in other examples may be any suitable suit, such as an oval, circle, square, or triangle. The length 23PI may be about 2 mm from the beginning surface 2180 of the guard bar 218 and the height 23Ph may be about 1 mm from the top side 202. In at least one example, the second pivot axis 23P may be about 0.5 times the length 23PI and the height 23Ph. For example, as illustrated in FIG. 8B, the second pivot axis 23P may be about 1 mm from the beginning surface 2180 of the guard bar 218 and about 1 mm from the top side 202. With the pivot axis location out of the area of the blades 216, the force that is applied during shaving by the user may be absorbed, as the force may not applied on the blades 216, resulting in a less aggressive shaving experience. As such, the head converter 22 provides a customized and more precise and comfortable shaving experience for the user.

When the blade unit 200 is coupled with the head converter 22 and frame 230, the blade unit 200 may be substantially immovable. For example, the blade unit 200 substantially does not move separately from the frame 230 when seated within the frame 230 and the seat 240 and connected with the coupling structure 233 and hooks 220. Also along the bottom side 239 of the frame 230, at least one of the supports 232 may include a camming surface 252. The camming surface 252 of the frame 230 may abut the biasing member 298 of the handle 290 such that the frame 230 and the blade unit 200 pivot together without separate movement.

The frame 230 may be substantially rectangular, but the shape of the frame 230 may be different shapes such as ovoid or circular, without deviating from the scope of the present concept. The frame 230 may be made with any moldable material such as metal, plastic or glass, or other materials such as wood, or any combination thereof.

The interconnecting member 260 may be pivotably coupled with the frame 230. The interconnecting member 260 may include a plurality of attachment components 266 which correspond with two depressions 254 (shown in FIG. 5B) in the bottom side 239 of the frame 230 such that the interconnecting member 260 may be pivotably coupled with the frame 230. In at least one example, the attachment components 266 may be shell bearings. Other methods of pivotably coupling the interconnecting member 260 and the frame 230 may be provided without deviating from the scope of the present concept.

The interconnecting member 260 includes a housing 262. The housing 262 may have a recessed portion 263 which is configured to receive a connecting portion 296 of the handle 290. As such, the connecting portion 296 may be inserted into the recessed portion 263 to provide coupling of the interconnecting member 260 and the handle 290. The interconnecting member 260 may also include an aperture 264 through which the biasing member 298 of the handle 290 may extend to interact with the frame 230. The aperture 264 may be in communication with the recessed portion 263 of the interconnecting member 260. However, the handle 290 may be coupled with the interconnecting member 260 to interact with the frame 230 in other ways without deviating from the present concept, so long as the handle 290 is coupled with the head converter 22, and the biasing member 298 interacts with the shaving head 23.

Figures 9A, 9B:
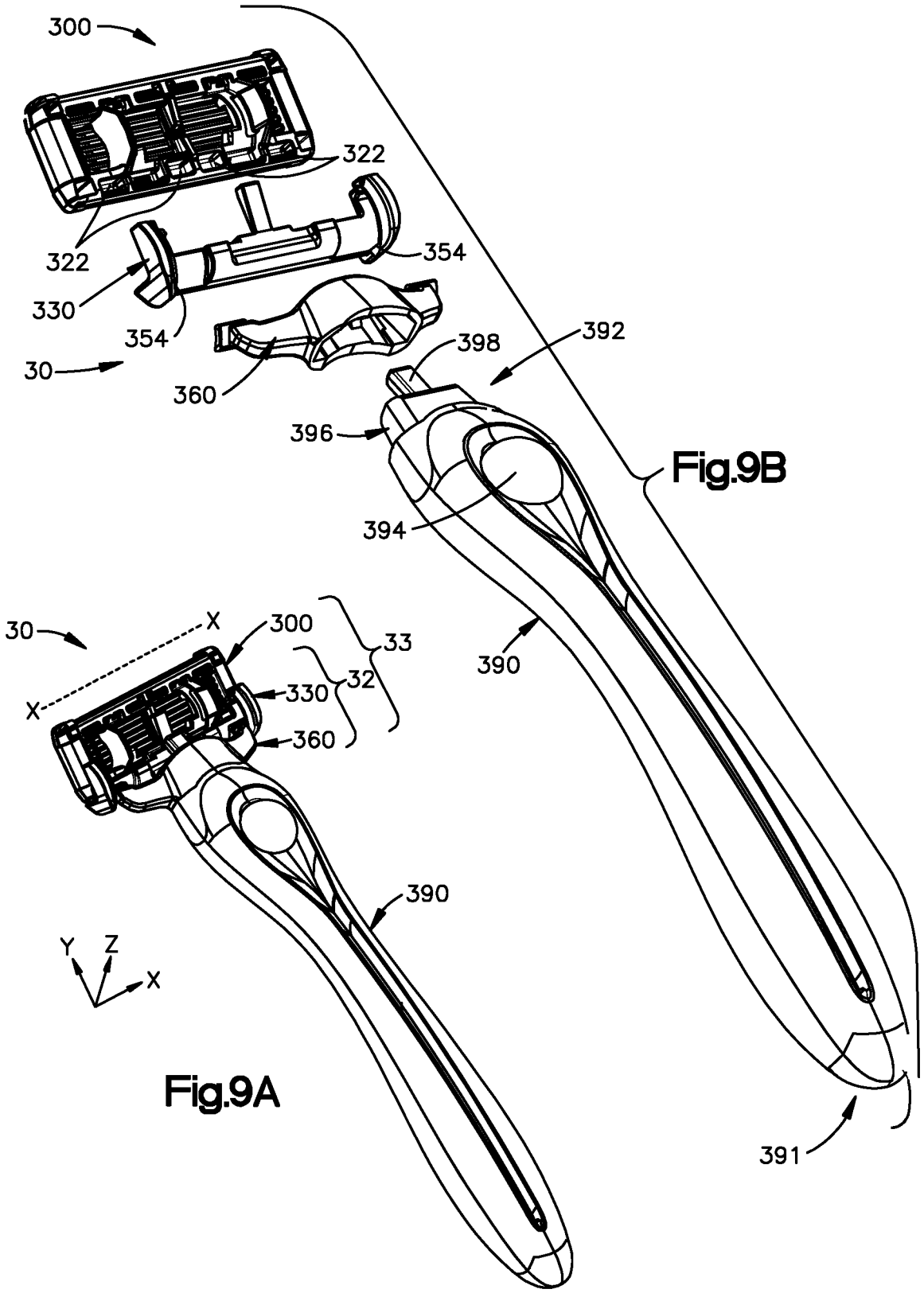
FIG. 9A is a diagram illustrating a perspective view of a shaving razor with a handle, a third example of a head converter, and a blade unit.
FIG. 9B is a diagram illustrating an exploded, perspective view of the shaving razor of FIG. 9A.

FIGS. 9A-9B illustrates another example of a shaving razor 30 which includes a handle 390 coupled with a shaving head 33. The shaving head 33 may include a blade unit 300 and a head converter 32. The head converter 32 may include a frame 330 and an interconnecting member 360. In at least one example, the frame 330 may be configured to removably couple with the blade unit 300. In other examples, the frame 330 may be fixedly coupled with the blade unit 300. The frame 330 may be pivotably coupled with the interconnecting member 360, and the interconnecting member 360 may be configured to be coupled with the handle 390. The frame 330 may be fixedly coupled with the interconnecting member 360. In other examples, the frame 330 may be removably coupled with the interconnecting member 360. In yet other examples, the head converter 32 may not include an interconnecting member 360 such that the frame 330 is directly coupled with the handle 390.

The handle 390 extends in a handle direction along the Y-axis between a proximal end 391 and a distal end 392. The shaving head 33 may be coupled with the distal end 392 of the handle 390. In at least one example, the shaving head 33 may be removably coupled with the handle 390, for example, by a lock and release mechanism. In other examples, the shaving head 33 may be fixedly coupled with the handle 390 such that the shaving head 33 may not be configured to be removably coupled with or selectively separated from the handle 390. The handle 390 may be operable to pivot relative to the shaving head 33. In other examples, the handle 390 may be secured to the shaving head 33 in a fixed relationship such that the shaving head 33 is not operable to pivot relative to the handle 390. The handle 390 may be any suitable shape to allow a user to securely grip the handle 390. The handle 390 may also include one continuous curve or include one straight portion or several curved and/or straight portions extending along an entirety of or a substantial portion of the handle 390 without deviating from the scope of the present concept. The handle 390 may include a button 394 which may also function as a finger rest area. The button 394, as illustrated in FIGS. 9A and 9B may be spherical, but may be any suitable shape to function as a button or a finger rest area. The handle 390 may also include a connecting portion 396. The connecting portion 396 may be configured to connect the handle 390 with the shaving head 33. The connecting portion 396 may include a biasing member 398. The biasing member 398 may abut the shaving head 33 to bias the shaving head 33 in a pivotal direction. The biasing member 398 may include a spring such that when the shaving head 33 incurs an external force to pivot, the spring compresses and may exert a force against the external force such that if the external force is removed, the shaving head 33 pivots back to a resting position.

Figure 10:
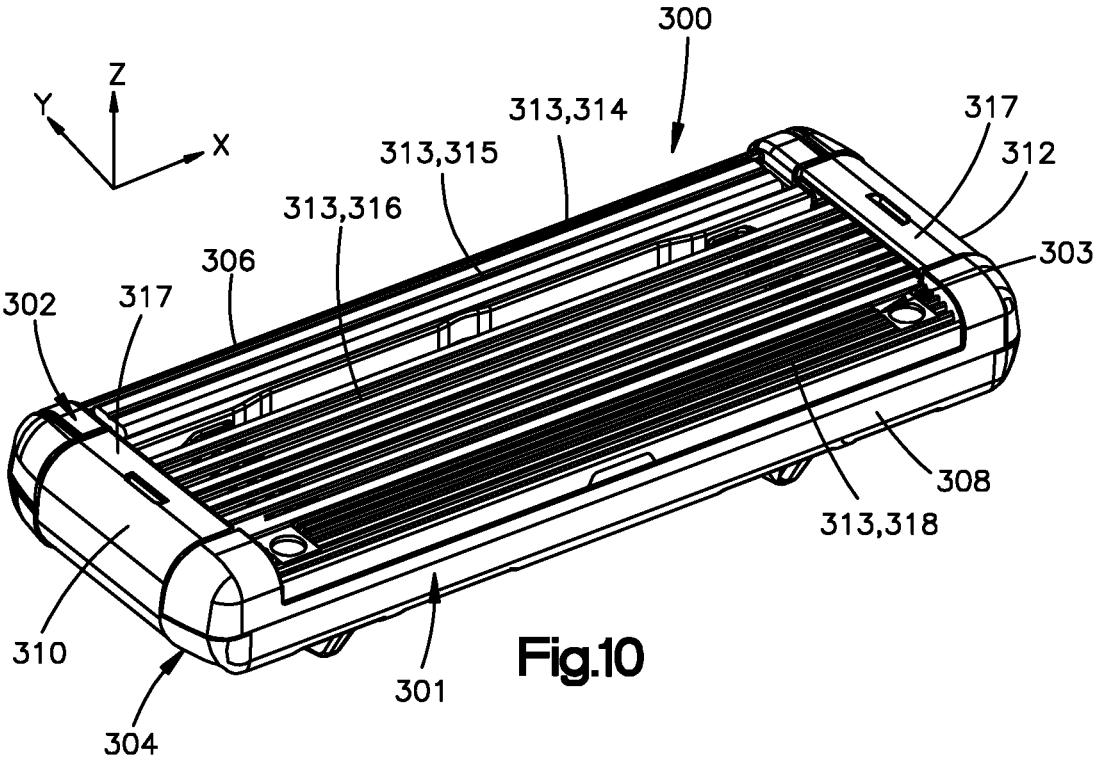
FIG. 10 is a diagram illustrating a perspective view of the blade unit of FIG. 9A.
Figure 11A:
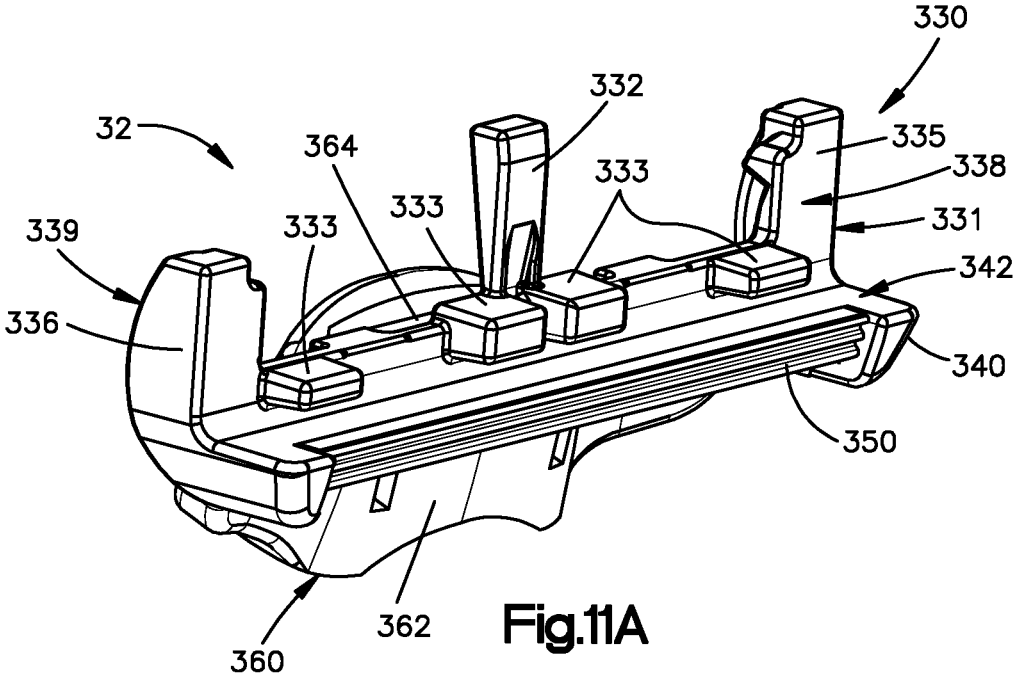
FIG. 11A is a diagram illustrating a top, perspective view of the head converter of FIG. 9A with a frame and an interconnecting member.
Figure 11B:
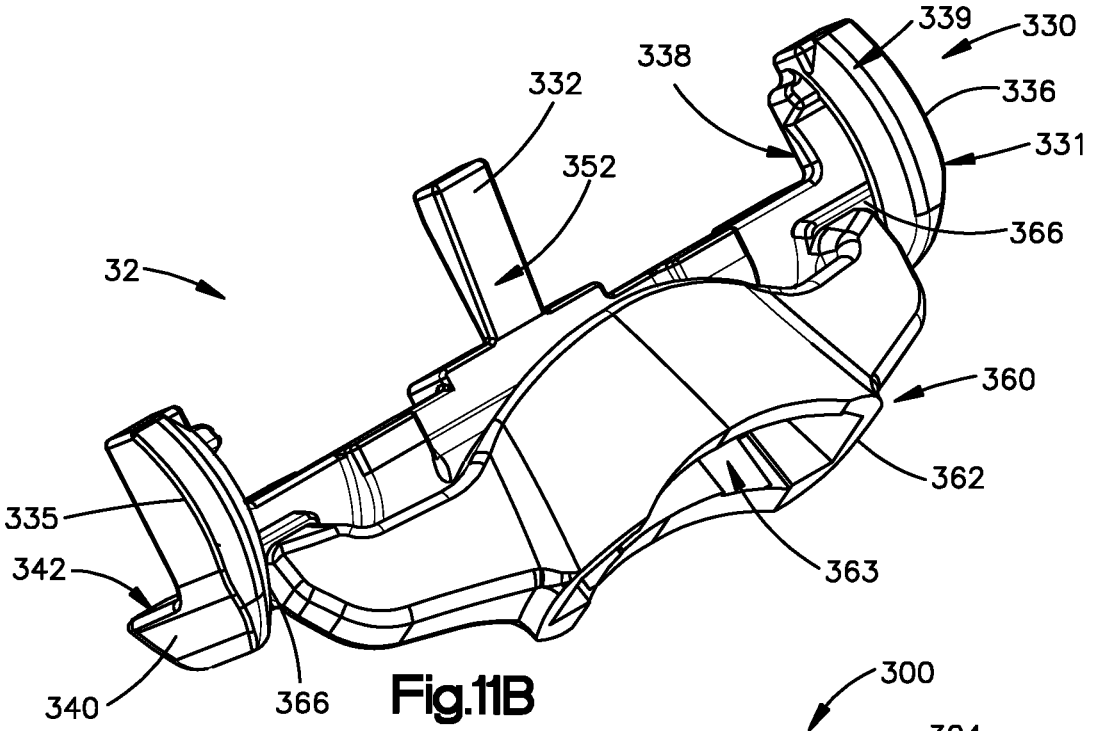
FIG. 11B is a diagram illustrating a bottom, perspective view of the head converter of FIG. 9A with a frame and an interconnecting member.

As illustrated in FIG. 10, the blade unit 300 includes a housing 301. The housing 301 extends along a longitudinal axis X-X. The housing 301 may have a substantially rectangular shape, but may be any suitable shape such as ovoid or circular without deviating from the scope of the present concept. The blade unit 300 and the housing 301 may include a top side 302 and a bottom side 304 opposite the top side 302. The bottom side 304 is proximate to the handle 390, and the top side 302 may include at least one skin contacting area 303. The housing 301 may include first and second longitudinal walls 306, 308. Each of the first and second longitudinal walls 306, 308 may extend longitudinally along the longitudinal axis X-X between the top and bottom sides 302, 304 and in a direction Z of the housing 301. The first and second longitudinal walls 306, 308 may extend substantially parallel to each other. First and second side walls 310, 312 may extend substantially parallel to each other and between the first and second longitudinal walls 306, 308 along a direction Y of the housing 301. The first and second side walls 310, 312 may also extend between the top and bottom sides 302, 304 along the direction Z of the housing 301. The housing 301 may be made of plastic, metal, another suitable material, or any combination thereof without deviating from the scope of the present concept.

The blade unit 300 may include a plurality of components 313 which assist and contribute to the shaving experience of the user. One of the plurality of components 313 may include a plurality of blades 316 disposed and retained within the housing 301. The blades 316 may extend along the longitudinal axis X-X. In at least one example, the blade unit 300 may include one, two, three, four, or more of the blades 316 without deviating from the scope of the present concept. The plurality of blades 316 may be movably disposed or freely mounted, in the housing 301. For example, the plurality of blades 316 may be coupled with elastic fingers which extend from the housing 301. In other examples, the plurality of blades 316 may be fixedly disposed in the housing 301.

The plurality of components 313 of the blade unit 300 may also include a cap 314, a lubricating strip 315, and a guard bar 318 disposed on and/or retained within the shaving head 33. The cap 314 may be coupled with the first longitudinal wall 306. The lubricating strip 315 may be disposed on the top side 302 of the cap 314 to deliver a friction reduction effect, an anti-irritation effect, and/or provide lubrication after shaving. The guard bar 318 may be coupled with the second longitudinal wall 308 opposite the cap 314 to stretch the skin during shaving or dispense the forces applied to the skin, thereby causing the blade unit 300 to glide across the skin while providing a closer shave. The cap 314, the lubricating strip 315, and the guard bar 318 may each extend along the longitudinal axis X-X. Additional components, e.g., a cover and/or one or more trimming blades, may also be included on and retained within the blade unit 300 without deviating from the scope of the present concept.

One or more of the plurality of components 313 may be retained within or on the shaving head 33 by retainers 317. For example, the retainers 317 may be operable to retain the blades 316, the cap 314, the lubricating strip 315, and/or the guard bar 318 on or within the blade unit 300. As illustrated, the retainers 317 retain the plurality of components 313 by securely abutting and partially covering (i) a portion of the plurality of components 313, for example lateral sides, or ends of the plurality of components 313 along the direction X, and (ii) the side walls 310, 312. The retainers 317 may be operable to secure one or more other components within or on the blade unit 300 without deviating from the scope of the present concept. One or more of the plurality of components 313 may be secured to the blade unit 300 without the retainers 317, for example via other means, without deviating from the scope of the present concept.

The blade unit 300 may be configured to be removably coupled with a head converter 32, which is illustrated in FIGS. 11A, 11B, 12A, and 12B. The head converter 32 may include a frame 330 and an interconnecting member 360 which may be pivotably coupled with the frame 330. The frame 330 may include a housing 331 that extends along the longitudinal axis X-X. The housing 331 may also include two sides 335, 336 which extend along the Y direction which may function as support for the blade unit 300. The frame 330 may also include one or more supports 332 which extend from the housing 331. The illustrated example in FIGS. 9A-12 shows only one support 332; however, more supports 332 may be incorporated without deviating from the scope of the present invention. The support 332 may be configured to assist in providing support to the bottom side 304 of the blade unit 300. The support 332 may be provided between the two sides 335, 336. As illustrated, the support 332 may be equidistant between the two sides 335, 336, but may also be disposed at any desired location, so long as adequate support for the blade unit 300 is provided. The support 332 may extend from the housing 331 along the Y direction, substantially parallel with the two sides 335, 336. However, the supports 332 may be provided in the frame 330 along the longitudinal axis, extending between the two sides 335, 336 or in any other desired orientation without deviating from the scope of the present concept, so long as the supports 332, along with the frame, provide support to the blade unit 300.

In the example illustrated in FIGS. 9A-12, the housing 331 of the frame 330 does not include a top bar which extends along the longitudinal axis X-X that spans between the two sides 335, 336 and creates a substantially rectangular frame 330. As such, the two sides 335, 336 and the supports 332 may not be connected, which may decrease the amount of material needed and may also decrease the cost of production of the head converter 32.

The frame 330 may have a top side 338 and a bottom side 339 opposite the top side 338. The top side 338 of the frame 330 may abut and support the bottom side 304 of the blade unit 300. Along the top side 338 of the housing 331, the frame 330 may include at least one protrusion 333. As illustrated, the frame 330 includes four protrusions 333, but the number of protrusions 333 may vary as desired. The at least one protrusions 333 may be configured to be received by corresponding recesses 322 (shown in FIG. 9B) which may be provided along the bottom side 304 of the blade unit 300. The at least one protrusions 333 and the recesses 322 may be configured to be connected such that the blade unit 300 may be removably coupled with the frame 330. Different and/or additional methods of removably coupling the blade unit 300 with the frame 330 may be provided without deviating from the scope of the present concept. When the blade unit 300 is removably coupled to the frame 330, the blade unit 300 may be exchanged when dull or as desired without having to purchase and provide an entirely new shaver head or shaving razor. Accordingly, being able to remove separately the blade unit 300 may provide a lower-priced option. Also, the frame 330 and the head converter 32 may be used in conjunction with different blade units 300 and handles 390 to provide customization as desired. In other examples, the blade unit 300 may be fixedly coupled with the frame 330 such that the blade unit 300 may not be removably coupled with the frame 330.

A seat 340 may extend along the top side 338 of the frame 330. The seat 340 may extend from the frame 330 such that the blade unit 300 may be connected to the frame 330 by sitting in the frame 330 and the seat 340. The seat 340 may extend from the frame 330 in the Z direction. As illustrated, the seat 340 may be substantially perpendicular to the frame 330; however, the seat 340 may extend from the frame 330 at any desired angle without deviating from the scope of the present concept. The seat 340 may have a seat surface 342 on which the second longitudinal wall 308 of the blade unit 300 may be received. For example, the blade unit 300 may sit in the head converter 32 while abutting the top side 338 of the frame 330 and the seat surface 342 of the seat 340.

The seat 340 may include a top surface 350. The top surface 350 of the seat 340 may provide customization to the shaving head 33. For example, the top surface 350 of the seat 340 may function as a lubricant, as a guard bar, to provide glide assistance, and/or any other desired function. As such, the top surface 350 of the seat 340 may allow for a new or extra function for the blade unit 300 without the user having to purchase an entirely new shaving head. Further, the seat 340, in function, may provide an extended wall for the blade unit 300. Accordingly, the skin contact surface of the shaving head 33 may be expanded. Also, the angle that the skin contacts the seat 340 may be different than that of the second longitudinal wall 308 of the blade unit 300.

Figure 12A:
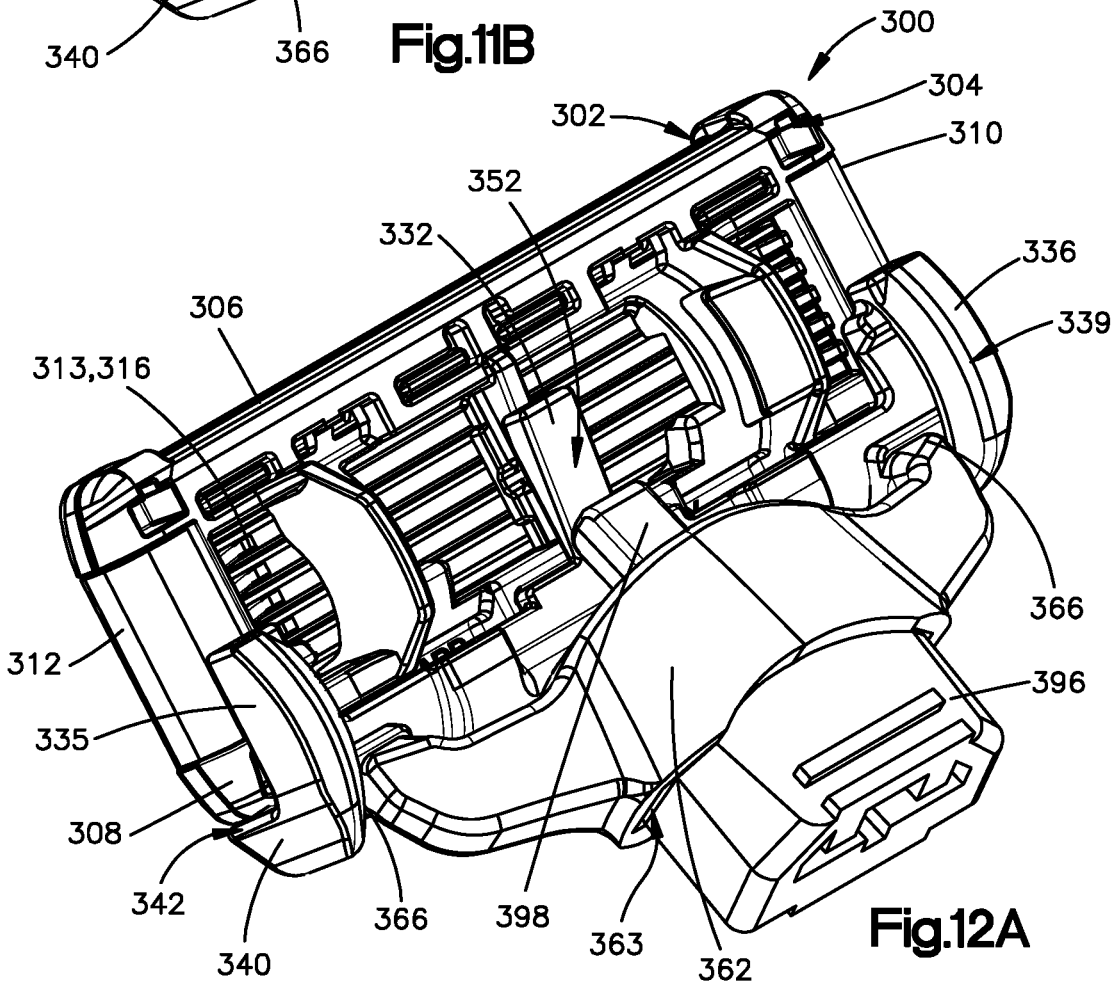
FIG. 12A is a diagram illustrating a bottom, perspective view of the head converter of FIG. 9A coupled with the blade unit and a portion of the handle.
Figure 12B:
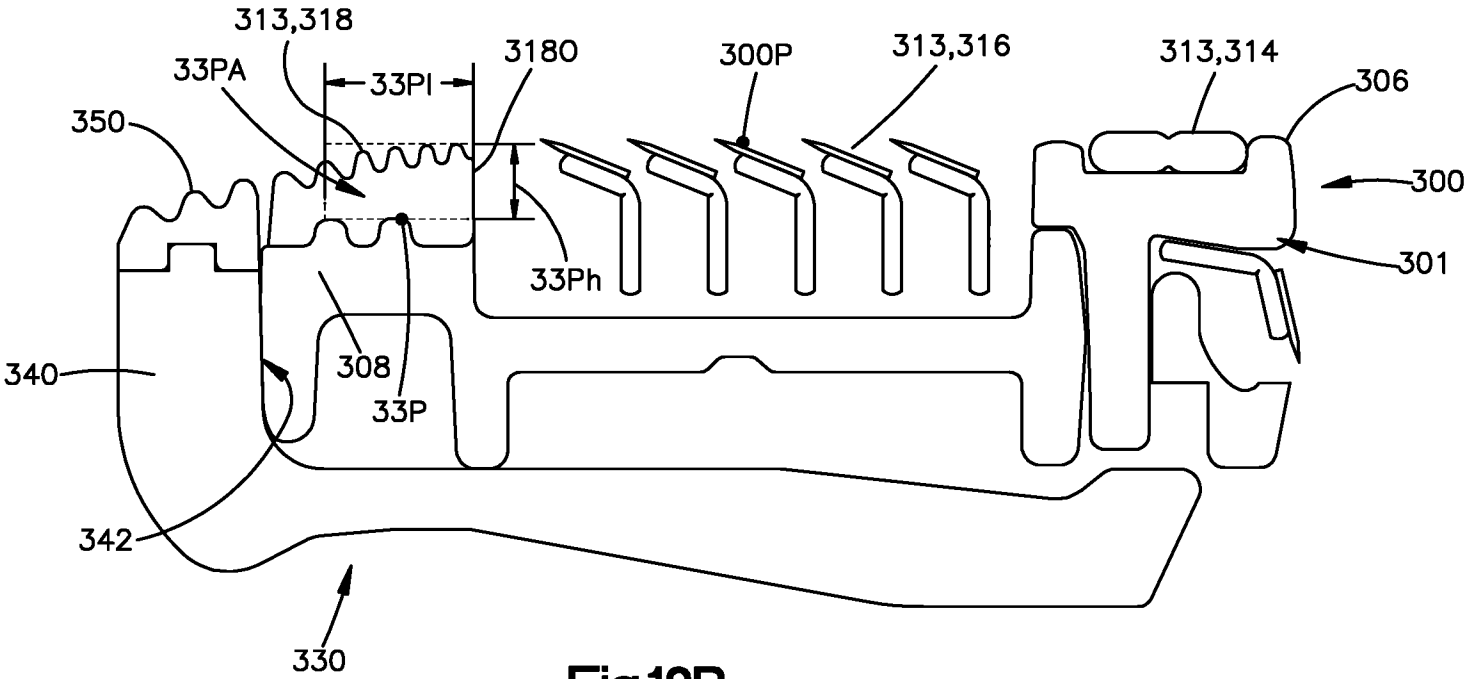
FIG. 12B is a diagram illustrating a cross-sectional view of the frame coupled with the blade unit.

As illustrated in FIG. 12B, the blade unit 300, without a head converter 32, may pivot about a first pivot axis 300P. For example, the first pivot axis 300P may be located approximately at the middle of the distance between the guard bar 318 and the cap 314, which may be parallel to the edges of the blades 316 and the longitudinal axis. However, when the blade unit 300 may be coupled with the head converter 32, the shaving head 33 pivots about a second pivot axis 33P which may be parallel to the longitudinal axis X-X. The first pivot axis 300P and the second pivot axis 33P can be different. The second pivot axis 33P may be located in an area 33PA, for example, out of the area of the blades 316. Area 33PA may be in front of the blades 316 and within the area of the guard bar 318. Area 33PA may have a length 33PI from a beginning surface 3180 of the guard bar 318 and a height 33Ph from the top side 302. Area 33PA, as shown in a cross-sectional view as in FIG. 12B, may have a substantially rectangular shape, but in other examples may be any suitable suit, such as an oval, circle, square, or triangle. The length 33PI may be about 2 mm from the beginning surface 3180 of the guard bar 318 and the height 33Ph may be about 1 mm from the top side 302. In at least one example, the second pivot axis 33P may be about 0.5 times the length 33PI and the height 33Ph. For example, as illustrated in FIG. 12B, the second pivot axis 33P may be about 1 mm from the beginning surface 3180 of the guard bar 318 and about 1 mm from the top side 302. With the pivot axis location out of the area of the blades 316, the force that may be applied during shaving by the user may be absorbed, as the force may not be applied on the blades 316, resulting in a less aggressive shaving experience. As such, the head converter 32 may provide a customized and more precise and comfortable shaving experience for the user.

When the blade unit 300 may be coupled with the head converter 32 and frame 330, the blade unit 300 may be substantially immovable. For example, the blade unit 300 substantially may not move separately from the frame 330 when seated within the frame 330 and the seat 340 and may be connected with the protrusions 333 and recesses 322. Also along the bottom side 339 of the frame 330, at least one of the supports 332 may include a camming surface 352. The camming surface 352 of the frame 330 may abut the biasing member 398 of the handle 390 such that the frame 330 and the blade unit 300 may pivot together without separate movement.

The frame 330, as illustrated, is substantially rectangular, but it is foreseen that the shape of the frame 330 may be different shapes such as ovoid or circular, without deviating from the scope of the present concept. The frame 330 can be made with any moldable material such as metal, plastic or glass, or other materials such as wood or any combination thereof.

The interconnecting member 360 may be pivotably coupled with the frame 330. The interconnecting member 360 may include a plurality of attachment components 366 which correspond with two depressions 354 (shown in FIG. 9B) in the bottom side 339 of the frame 330 such that the interconnecting member 360 may be pivotably coupled with the frame 330. In at least one example, the attachment components 366 may be shell bearings. Other methods of pivotably coupling the interconnecting member 360 and the frame 330 may be provided without deviating from the scope of the present concept.

The interconnecting member 360 may include a housing 363. The housing 363 may have a recessed portion 363 which is configured to receive a connecting portion 396 of the handle 390. As such, the connecting portion 396 may be inserted into the recessed portion 363 to provide coupling of the interconnecting member 360 and the handle 390. The interconnecting member 360, as illustrated, may also include an aperture 364 through which the biasing member 398 of the handle 390 may extend to interact with the frame 330. The aperture 364 may be in communication with the recessed portion 363 of the interconnecting member 360. However, the handle 390 may be coupled with the interconnecting member 360 to interact with the frame 330 in other and/or additional desirable ways without deviating from the present concept, so long as the handle is coupled with the head converter 32, and the biasing member 398 interacts with the camming surface 352 of the frame 330 of the head converter 32.

It will be appreciated by those skilled in the art that changes could be made to the examples described above without departing from the broad concept thereof. It is understood, therefore, that the present disclosure herein is not limited to the particular examples disclosed, and is intended to cover modifications within the spirit and scope of the present concept.

What is claimed is:

1. A head converter comprising:

a frame configured to be coupled with a blade unit, the frame extending along a longitudinal axis and including:

one or more supports, at least one of the one or more supports having a camming surface configured to abut and interact with a biasing member; and an interconnecting member pivotably coupled with the frame and configured to be coupled with a handle, the blade unit having a first pivot axis;

when the blade unit and the frame are coupled, the frame with the blade unit pivot along a second pivot axis;

the first pivot axis and the second pivot axis being different.

2. The head converter of claim 1, wherein the frame and the supports are configured to provide support to a bottom side of the blade unit.

3. The head converter of claim 2, further comprising a seat extending from the frame such that the blade unit is connected to the frame by sitting in the frame and the seat.

4. The head converter of claim 3, wherein a top surface of the seat is configured to function as a lubricant, glide assistance, or a guard bar.

5. The head converter of claim 1, wherein at least one of the one or more supports having a coupling structure, the coupling structure configured to interact with corresponding hooks on the blade unit such that the blade unit is coupled with the frame.

6. The head converter of claim 1, wherein the frame is configured to be removably coupled with the blade unit.

7. The head converter of claim 1, wherein the frame includes at least one protrusion configured to be received by corresponding recesses in the blade unit such that the blade unit is coupled with the frame.

8. The head converter of claim 1, wherein the interconnecting member includes a recessed portion configured to receive a connecting portion of the handle.

9. The head converter of claim 1, wherein the frame includes two depressions;

the interconnecting member includes two attachment components which correspond with the two depressions in the frame such that the interconnecting member is pivotably coupled with the frame, the two attachment components are shell bearings.

10. A shaving razor comprising:

a handle;

a head converter removably coupled with the handle, the head converter including:

a frame extending along a longitudinal axis and including:

one or more supports, at least one of the one or more supports having a camming surface configured to abut and interact with a biasing member;

an interconnecting member pivotably coupled with the frame and configured to be coupled with the handle; and a blade unit coupled with the head converter, the blade unit having a first pivot axis;

when the blade unit and the frame are coupled, the frame with the blade unit pivot along a second pivot axis;

the first pivot axis and the second pivot axis being different.

11. The shaving razor of claim 10, wherein the frame and the supports are configured to provide support to a bottom side of the blade unit.

12. The shaving razor of claim 11, further comprising a seat extending from the frame such that the blade unit is connected to the frame by sitting in the frame and the seat.

13. The shaving razor of claim 12, wherein a top surface of the seat is configured to function as a lubricant, glide assistance, or a guard bar.

14. The shaving razor of claim 10, wherein the frame is configured to be removably coupled with the blade unit.

15. The shaving razor of claim 10, wherein at least one of the one or more supports having a coupling structure, the coupling structure configured to interact with corresponding hooks on the blade unit such that the blade unit is coupled with the frame.

16. The shaving razor of claim 10, wherein the frame includes at least one protrusion configured to be received by corresponding recesses in the blade unit such that the blade unit is coupled with the frame.

17. The shaving razor of claim 10, wherein the interconnecting member includes a recessed portion configured to receive a connecting portion of the handle.

18. The head converter of claim 8, wherein the interconnecting member includes an aperture through which the biasing member of the handle extends to interact with the camming surface of the frame.

19. The head converter of claim 17, wherein the interconnecting member includes an aperture through which the biasing member of the handle extends to interact with the camming surface of the frame.

20. The shaving razor of claim 1, wherein the blade unit is substantially immovable when coupled to the frame.

* * * * *